US010902711B2

(12) United States Patent
Alpert

(10) Patent No.: US 10,902,711 B2
(45) Date of Patent: Jan. 26, 2021

(54) FACILITY MONITORING APPARATUS AND METHOD

(71) Applicant: Martin Alpert, Beachwood, OH (US)

(72) Inventor: Martin Alpert, Beachwood, OH (US)

( * ) Notice: Subject to any disclaimer, the term of this patent is extended or adjusted under 35 U.S.C. 154(b) by 0 days.

(21) Appl. No.: 16/168,078

(22) Filed: Oct. 23, 2018

(65) Prior Publication Data

US 2019/0130718 A1 May 2, 2019

Related U.S. Application Data

(60) Provisional application No. 62/575,548, filed on Oct. 23, 2017.

(51) Int. Cl.

| | |
|---|---|
| ***G08B 19/00*** | (2006.01) |
| ***G08B 27/00*** | (2006.01) |
| ***G08B 26/00*** | (2006.01) |
| ***G08B 25/00*** | (2006.01) |

(52) U.S. Cl.

CPC ..... *G08B 19/00* (2013.01); *G08B 25/006* (2013.01); *G08B 26/008* (2013.01); *G08B 27/005* (2013.01)

(58) Field of Classification Search

CPC ..... G08B 19/00; A61B 5/721
USPC ..... 340/517
See application file for complete search history.

(56) References Cited

U.S. PATENT DOCUMENTS

| | | | | |
|---|---|---|---|---|
| 10,393,394 | B2 * | 8/2019 | Anandhakrishnan | F24F 11/30 |
| 2008/0146890 | A1 * | 6/2008 | LeBoeuf | A61B 5/11 600/300 |
| 2010/0253509 | A1 * | 10/2010 | Fu | G16H 40/63 340/539.22 |
| 2016/0125729 | A1 * | 5/2016 | Clarke | H04W 4/90 340/577 |
| 2017/0124853 | A1 * | 5/2017 | Mehta | H04W 4/90 |

* cited by examiner

*Primary Examiner* — Qutbuddin Ghulamali
(74) *Attorney, Agent, or Firm* — Renner, Otto, Boisselle & Sklar, LLP

(57) ABSTRACT

An autonomous facility monitoring apparatus and method in a facility can remain on at all times and functions to determine whether an unauthorized person has entered or is attempting to enter the facility and/or whether an environmental danger exists or is predicted. Continuously monitoring physical characteristics of a person and/or location of a person in the facility provides information for automatically detecting and signaling a detrimental health condition, for automatically controlling operation of apparatus of the facility, for operating gaming features, and so on.

17 Claims, 8 Drawing Sheets

FACILITY MONITORING APPARATUS AND METHOD

FIELD OF TECHNOLOGY

The present disclosure relates to an autonomous facility monitoring apparatus and method, and, more particularly, to an autonomous facility monitoring apparatus and method that may be permitted to operate continuously without user direct input(s).

BACKGROUND

Conventional security systems, such as home, office or facility security devices, require sensor installation at various locations such as doors, windows, or space within a room. Conventional security devices include switches, e.g., to sense opening of a door or window, glass breakage detectors, motion detectors, and so on. Some conventional security systems require visual recognition of a person entering a facility to confirm that the person is authorized to enter. Such visual recognition requires variable personal parameter(s) (hereinafter, also referred to as "VPPs") to have been stored in advance to be compared with a real time VPP view of a person, e.g., as provided by a camera, the comparison being made by existing facial recognition software. The real time VPPs, e.g., the image of the entering person, must be in the line of sight of a camera in order to detect the person, thereby limiting the geographic reach of the security system. If the person cannot be seen by the security system because, for instance, an object lies between the person and the security system camera or the person enters into a room or hallway or onto a floor in which the security system is not installed, e.g., the person enters through an open window that is not in view of the camera, there may be a security breach. If the person's face is covered, the visual recognition system cannot recognize the person, thereby, missing an opportunity to prevent a possible security breach.

Conventional security systems that require multiple sensors at different locations are subject to failure if one or more of the sensors fails or becomes disconnected whether inadvertently (e.g., wire breaks, battery loses charge, etc.) or if a thief were to cause disablement intentionally. Conventional security systems that require multiple sensors require installation at every possible entrance location which may be difficult to determine, e.g., a thief cuts a hole in a wall for ingress, and/or to wire or they require a unit in every room which can be expensive, cumbersome, inefficient and require a lot of power. Some points of possible entry such as vents may not be readily accessible or addressed by conventional devices or would be very cumbersome and expensive at which to install security devices. Some locations may also be missed. Another annoying problem for current visual systems is notifying a user or the system itself of all changes, e.g., a change in a visual field due to a rearrangement of furniture. The annoyance is such that many users turn off the visual recognition to not be constantly informed of changes in the visual field which reduces or even eliminates its purpose.

In addition, a conventional security system requires a user to turn the security system on or off. This makes it necessary for the user to remember whether and when they turned on or off the system, possibly leading to situations under which the system may not be on when the system should be on or may cause a false alarm when the system should have been off, e.g. a legal or authorized occupant at the facility opens a secure door or goes off in the middle of the night when the user does something inadvertently.

SUMMARY

This disclosure relates to an autonomous monitoring apparatus that combines a security system, an environmental and personal monitoring system, an information system, and facility automation systems one or more of which operate collaboratively to monitor and to predict security, personal or environmental parameters and their consequences. The autonomous monitoring apparatus also may determine whether the results of comparing detected parameters with stored parameters and with other available information predicts an undesirable event and in response to such prediction provides an output representative of having predicted a current or future undesirable event. Moreover, in response to predicting a current or future undesirable event, the autonomous monitoring apparatus may act on such prediction, e.g., as is described further below.

The present disclosure relates to an autonomous facility monitoring apparatus and method that may detect, collect, compare, report and/or store information detected from sensors located within or in the vicinity of a facility. The sensors may measure personal, environmental, and/or structural elements and the autonomous monitoring apparatus may integrate the measurements with available information and automate responses. Detection of information may be performed using one or more sensors capable of monitoring sight, sound, light, odor, vibration, e.g., seismic, footsteps, temperature, or other events or parameters, which impact upon the facility structure, contents, and/or occupants. The autonomous facility monitoring apparatus also may compare the detected information with stored data and may report the detected information and the comparison results to a user, a call center and/or relevant authorities as separate or parallel notifications with or without performing an automatic sequenced response.

Further, the autonomous facility monitoring apparatus may include a controller operatively coupled to perform a machine learning functions, which may include a machine learning algorithm, e.g., that may be stored in a non-transitory memory of the apparatus. The controller performing the machine learning algorithm constantly receives, analyzes, learns and/or updates detected information. The controller in accordance with the machine learning algorithm may constantly monitor the status, contents and/or occupants of the facility and may autonomously make adjustments to maintain the facility in the preferred manner; and the apparatus may notify users, owners, a call center and/or authorities and/or may activate automation capabilities in the facility. Based upon the learning and analysis ability under the apparatus including the machine learning algorithm, the controller also may identify sensor patterns to anticipate and/or to predict failures or undesirable events (e.g. theft, fire, etc.) that would require actions or would identify where preventative measures would be beneficial.

The autonomous facility monitoring apparatus may avoid or eliminate a requirement to place multiple monitoring devices at different respective locations in a facility or may require fewer monitoring devices than in the past, while still being able to monitor a facility effectively. By sharing data between and among the sensors and detectors integrated therein, the autonomous facility monitoring apparatus operates in an efficient manner in performing prescribed functions. For instance, the autonomous facility monitoring apparatus may recognize who is outside the door or approaching a facility even before the person is at the door, and thus, allow the user a sufficient time to respond in an effective manner based on the detection result of the person that is communicated to the user by the apparatus.

Currently electronic components in the home are proliferating and are categorized in three primary areas: information (e.g., Amazon Echo), security (e.g., multiple camera devices such as Canary) and home automation (e.g., Smart Home). By being separate, they all have their own database that are related only to the function they are performing. Health condition monitoring sometimes is carried out in the home, e.g., as an individual uses exercise equipment that monitors heart rate, blood pressure, and stress level(s)—and values may be stored adding further data to a database. Gaming components (directly or via remote connection, e.g., via local wireless network and/or via internet connection) may be found in the home; gaming also may lead to changes in biologic data of the player, e.g., heart rate, stress level, and so on—also this is even more data that may be stored in a database.

In connection with gaming, for example, the autonomous security monitoring apparatus of this disclosure may monitor personal, biologic and facility data and may use that data/information to change the sequencing in a game. For example, if the biologic data shows high personal stress, the game could be programmed to increase or decrease stress, i.e., increase or decrease the excitement and or challenge levels provided by the game, etc.

In the past, security systems, gaming systems, and so on take up a lot of space at a facility, e.g., in a home or office. Their placement frequently requires multiple devices to provide the desired function(s). However, the autonomous facility monitoring apparatus provides for sharing data to provide for improved efficiency in the performance of the respective functions offered by the apparatus, and by integrating the functions, as described further below, the apparatus provides improved effectiveness, cost efficiency and energy conservation relative to prior individual systems.

The present disclosure involves the integration of functions in a way that individual functions are performed better and more efficiently and provides for new functionality that cannot be performed without this integration. For example, combining and/or integrating information, security, and automation provides a synergistic effect for functions capable of the autonomous facility monitoring apparatus, such as:

- Informing fire department personnel where inhabitants are located;
- Informing fire department personnel where fire is in a facility;
- Identifying a best route for inhabitants to escape fire or other emergency situation in a facility and for firemen to enter the facility for safer and more efficient control of a fire/emergency situation as compared to more randomly entering the facility;
- Putting on sprinkler system or fire avoidance/retarding system only where potential fire is recognized;
- Letting emergency (EMS) crews know where an afflicted/ill patient is located; and/or
- Controlling lights on/off, intensity and color of lights throughout the day for light fixtures/bulbs that incorporate these control capabilities (such as eliminating blue from light at night to promote sleeping and health).

An exemplary embodiment of the autonomous facility monitoring apparatus (hereinafter, also referred to as the "apparatus") has at least one sensor configured to detect at least one variable personal parameter or at least one change in the at least one personal parameter (discussed further infra); at least one detector configured to detect at least one environmental parameter or at least one change in the at least one environmental parameter (discussed further infra); a comparator in electrical communication with the at least one sensor and the at least one detector and use the information independently or combine the information to provide more efficient and reliable analysis to ascertain, analyze and compare a first incoming input from the at least one sensor with a first stored data representative of the at least one variable personal parameter for use in determining a matching relationship (discussed further infra) therebetween or to compare a second incoming input from the at least one detector with a second stored data representative of the at least one environmental parameter or an acceptable range of the at least one environmental parameter or combination thereof; and a controller in electrical communication with the at least one sensor, the at least one detector and the comparator, the controller being configured to (i) receive a comparison result from the comparator, (ii) create an output having a prediction of a possible occurrence of an undesirable event based on the comparison result including at least one of unmatched variable personal parameter or the change in the personal parameters or combination thereof, detected environmental parameter or the change in the environmental parameter outside of the acceptable range or combination thereof, (iii) at least one of transmit the output to a user device and store the output, ask for a user instruction, send an alert with the output to a call center or relevant authority in electrical communication with the controller, set off a programmed response or combination thereof, and (iv) update the learning algorithm.

Another aspect of the present disclosure is a method for autonomously monitoring a facility by continuously detecting at least one variable personal parameter or at least one change in the personal parameter, at least one environmental parameter, or at least one change in the environmental parameter; comparing detected variable personal parameter to a first stored data representative of at least one variable personal parameters or change in personal parameters, and comparing detected environmental parameter or change in the environmental parameter to a second stored data representative of at least one environmental parameter or an acceptable range of the change in the environmental parameter; creating an output representative of predicting an undesirable event based on a comparison result including one or more of unmatched variable personal parameter or change in the personal parameter, detected environmental parameter or the change in the personal parameter outside of the acceptable range, and at least one of transmitting the output to a user device and storing the output, asking for a user instruction, or sending an alert with the output to a call center or relevant authority, set off a programmed response, or combination thereof. For example, a personal detector change may indicate a person has fallen and cannot get up. The facility automation lighting may flash in the room where the detection of the fall occurred to alert responders where the person is. A triangulation using different subsonic sensors may facilitate determination of when and where the fall occurred even if sensors are not in the immediate local of the fall. Also, it may alert responders where a fire may be occurring. A fire may be detected by smoke detectors built into the apparatus or in any location in the facility in communication with the proposed device or viewed and recognized as a fire or smoke by the camera. A fire or smoke detected in any part of the facility will be communicated to all other devices through the communication system built into the device so if fire or smoke is detected anywhere in the facility, notification alarm(s) will be set off and would be sent to the user devices such as phone, PAD, PC, etc. In addition, the information may be stored and used later to identify a person(s) so that if there is an intrusion, the footsteps or odor or other personalized and measurable parameter, each of which and together are equivalent to a fingerprint identification, can be used to identify the person.

These and further features of the present invention will be apparent with reference to the following description and attached drawings. In the description and drawings, particular embodiments of the invention have been disclosed in detail as being indicative of some of the ways in which the principles of the invention may be employed, but it is understood that the invention is not limited correspondingly in scope. Rather, the invention includes all changes, modifications and equivalents coming within the spirit and terms of the claims appended hereto. Features that are described and/or illustrated with respect to one embodiment may be used in the same way or in a similar way in one or more other embodiments and/or in combination with or instead of the features of the other embodiments.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles in accordance with the present disclosure. Elements and features depicted in one drawing may be combined with elements and features depicted in other drawings. Additionally, in the drawings, like reference numerals designate corresponding parts throughout the several views.

DESCRIPTION

Figure 1A:
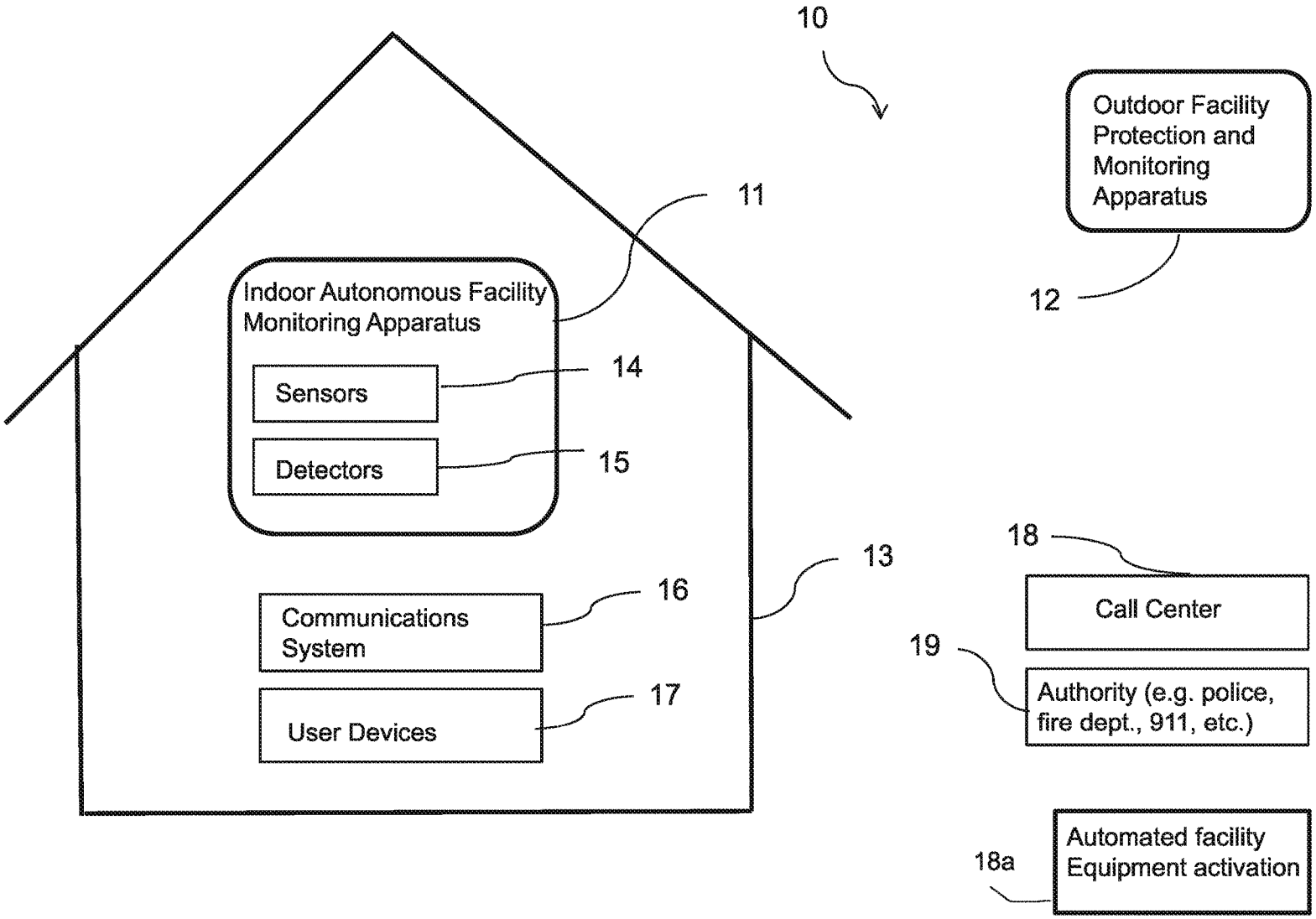
FIG. 1A is a diagram of operative portions of an exemplary autonomous facility monitoring apparatus shown used in a facility and also including an outdoor component in accordance with an embodiment of the present disclosure.

Embodiments in accordance with the present disclosure will now be described with respect to the drawings, wherein like reference numerals are used to refer to like elements throughout. It will be understood that the figures are not necessarily to scale.

Figure 1B:
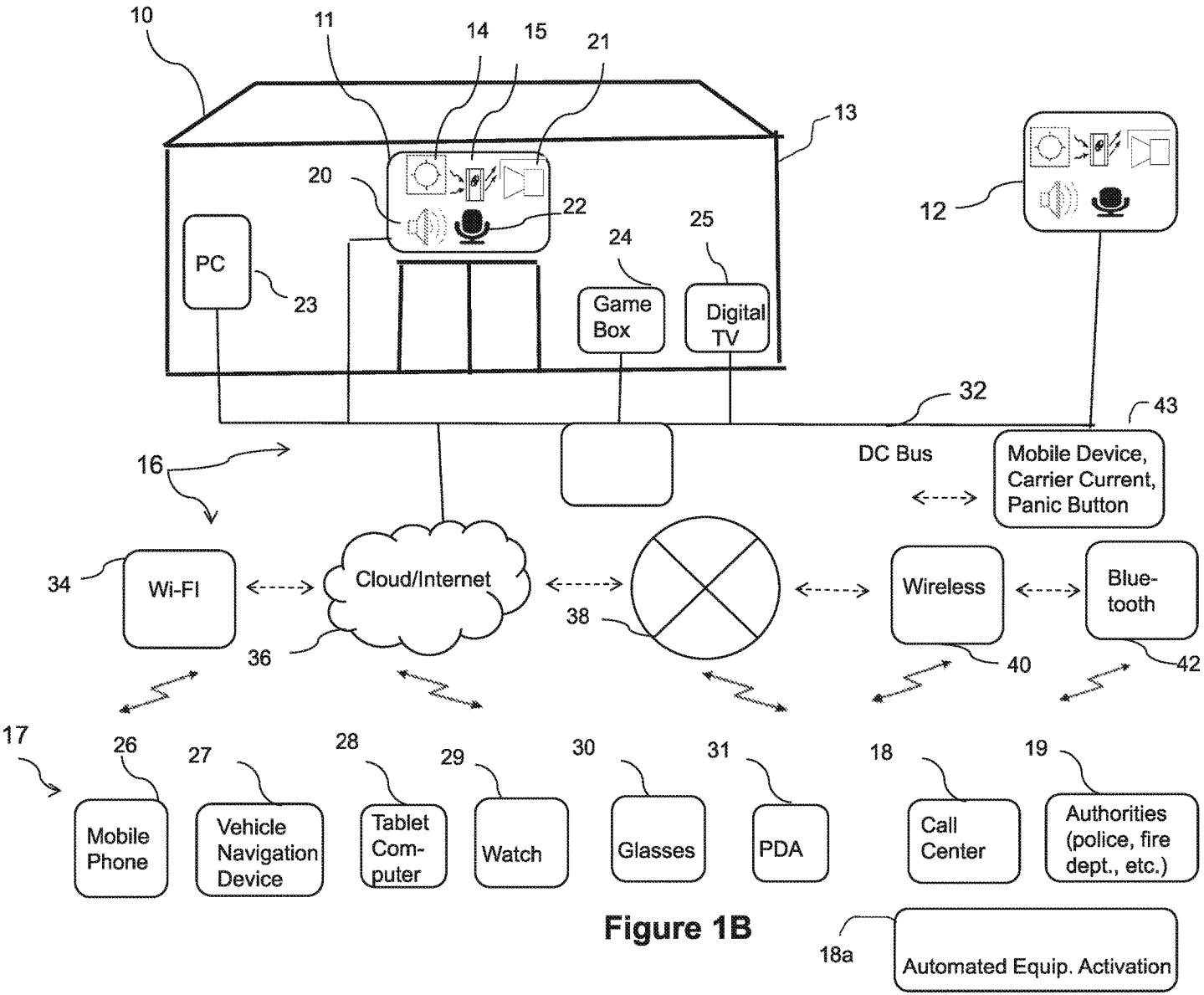
FIG. 1B is an expanded diagram of operative portions of an exemplary autonomous facility monitoring apparatus, as in FIG. 1A, showing a number of subcomponents or subsystems.

Referring initially to FIG. 1 (meaning to both FIGS. 1A and 1B), the autonomous facility monitoring apparatus 10 may be used to monitor sensors and detectors associated with a facility, either indoor, outdoor or both, to integrate or otherwise to use the sensed data and detected data and possibly to do comparisons with stored or archived data for various purposes, such as, for example, for security, for comfort, for health and/or for pleasure. As used herein, unless otherwise evident from context, the term integrate or the concept of integrating means that several pieces of information that may be from the same sensor or detector or from several sensors and/or detectors may be combined to arrive at a decision or determination of a fact, condition, and so on. The term integrate can be used to refer to providing several pieces of information to an algorithm, including an artificial intelligence agent such as a machine learning model, and using the output to determine access to a facility or information As an example, a vibration sensor, e.g., a seismic sensor, may be used to determine the weight of a person walking on a floor in a room, e.g., based on the deflection of the floor or vibration of the floor in response to footsteps, and a sound sensor may sense the sound produced by the footsteps; and the vibration sensor and the sound sensor may sense one or more frequencies, e.g., the speed at which the footsteps are produced, the number of vibrations produced as a result of one footstep, e.g., heavy person or light weight person, and so on; all of these may be combined in a label that identifies a particular person. If the values of those parameters that are sensed are recognized, e.g., by comparison with parameters representing a particular person, say, such values previously having been stored in a memory, then the person would be considered as recognized by the system; if not recognized, then possibly an alarm would be sounded or triggered or a user may opt to indicate that the person is acceptable to be in the facility and may add the values of the sensed parameters to the memory keyed to such person so next time the person is sensed the person would be identified as a recognized person.

For security, for example, the apparatus 10 may monitor whether an unauthorized person was to enter a premises. For comfort, for example, the apparatus 10 may control temperature, fresh air flow, lighting, and so on. For health, for example, the apparatus 10 may monitor heart rate, whether a person has fallen or calls out, and so on. For pleasure, for example, the apparatus 10 may control monitor and control gaming, it being appreciated that gaming may be useful for relaxation but also may lead to elevated stress levels as degree of difficulty increases.

Referring to FIG. 1A an exemplary autonomous facility monitoring apparatus 10 (also referred to as "AFMA" or "apparatus") provides one or more monitoring functions and also may provide control functions and alerting functions, as are described below. In the illustrated embodiment, the apparatus 10 includes an indoor autonomous facility monitoring apparatus portion 11 and an outdoor autonomous facility monitoring apparatus portion 12. The apparatus 10 may be used to monitor both within and/or the vicinity of a facility 13. The apparatus portions 11, 12 may be used alone or in combination to provide the monitoring and other functions. The apparatus portions 11, 12 include sensors 14 to sense various personal parameters and detectors 15 to detect environmental parameters. For convenience of brevity, the immediately following description of the apparatus 10 is directed to the indoor apparatus portion 11. The outdoor apparatus portion 12 is described further below. Also, parts or components of the indoor apparatus portion 11 and of the outdoor apparatus portion 12 may be the same or similar. The apparatus 10 is described below with reference to the indoor apparatus portion 11; the description of the apparatus 10, as referenced to the indoor apparatus portion 11, is similarly applicable to a description of the outdoor apparatus portion 12—although each portion 11, 12 may have their own components and functions, for example, as is described below.

The apparatus 10 includes information systems such as a communications system 16, which provides for communications between the apparatus 10 and a user device 17, a call center 18 and/or relevant authorities 19 (e.g. police, fire department or 911). In some embodiments, the communications system 16 can be an output configured to provide an output indication of the state of a system component. The communications system 16 may also connect to and receive or transmit information via the internet, the cloud, or the like. Exemplary user devices 17 may include information systems such as remote-control devices that provide information to a user and/or receive inputs from a user, e.g., like a smart phone, portable computer device, or the like. User devices 17 may include a fixed or movable control panel, e.g., like a typical control panel mounted on a wall, such as a thermostat, burglar/intrusion alarm panel, and so on. The control and information providing functions may be by manual touch, visual display, audible display, oral input, and so on. Another exemplary user device may be a transmitting device that transmits information that is sensed by a sensor, such as heart rate, breathing rate, breath characteristics, and so on. Breath characteristics may include, for example, oxygen, carbon dioxide or other factors that are in the exhaled breath of an individual. The communications system may also provide communication between various parts of the apparatus 10, e.g., within one of the portions 11, 12 and/or between portions 11, 12. To communicate with a call center 18 and/or relevant authorities 19, the communications system may include provision for telephone communication, radio communication, mobile phone communication, other wireless communication, internet communication and so on.

The sensors 14 and detectors 15 may be located inside and/or outside the facility 13. In an exemplary embodiment, the apparatus 10 may be physically located in one place in a facility 13 so as to be able to receive inputs from various sources based on sound, vibration, light, and so on. As several examples, the sound may be that of a person speaking or calling out, of a window or door opening, closing or breaking, and so on. As several examples, vibration may be that of a window or door breaking, of a person walking (e.g., gait), of an object falling and hitting the floor or a table, and so on. As several examples of light may be that of a room light turning on, a flashlight beam, sunrise or sunset, fire, smoke, and so on. Other parameters that may be sensed or detected by the apparatus 10 may include temperature, odor, humidity, and so on, some of which are described explicitly below as well as others.

The apparatus 10 may be of a form factor that facilitates placement on a table or floor, mounting on a wall or ceiling, or other positioning in a location in the facility 13 so as to carry out the various functions of the apparatus. Although an embodiment of apparatus 10 may include only a single package or unit, e.g., a box-like structure similar to a table top radio or a television, it will be appreciated that the apparatus 10 may be of desired size to contain the parts or components thereof. It also will be appreciated that, if desired, the apparatus 10 may include parts or components contained in several respective packages or units that are positioned in different respective locations and may communicate via the communications system 16.

The apparatus 10 may receive, obtain, and store various information about the facility 13. For example, after being positioned in the facility 13, the apparatus 10 may map the facility by inspecting the facility using various scanning and detecting techniques. For example, the apparatus 10 may use environmental parameter detectors to carry out optical scanning for line of sight information and electronic scanning for line of sight and also for "seeing" through walls to obtain information about the dimensions of one or more rooms and location of objects, e.g., furniture, in rooms, and so on. Using such information, the apparatus 10 may map out the facility 13. The apparatus 10 may also use environmental parameter detectors 15 to measure temperature in respective locations in the facility to create a temperature profile of the facility, e.g., that may be included in the map of the facility. Moreover, the apparatus 10 may include environmental parameter detectors that monitor electrical current and/or voltage at respective electrical outlets and include that information as a representative electrical profile of the facility. Further, the apparatus 10 may include in the map information about variations in the detected values, e.g., anticipated changes in temperature, brightness, electrical usage, and so on based on time of day (or night).

Further, the apparatus 10 may use sensors 14 to obtain information (variable personal parameters) about person(s) who are in and who are expected to be in the facility 13. The sensors can be configured to sense one or more personal parameters associated with one or more respective persons within or in proximity of the facility. Examples may include voice sensing, gait sensing, body physical characteristics such as temperature or heart rate sensing, and so on. This sensed information may be stored in the apparatus 10 for various uses, as are described in further detail below.

Several examples of using information stored and/or obtained by the apparatus are summarized here and are described in further detail below. One example, is a predictive function: In response to detecting a use of electrical power at a given electrical outlet and the temperature at the electrical outlet, predicting the possibility of a fire there—a control function may be to reduce or to cut off the electrical power for that electrical outlet. Another example, is a safety evacuation function: In response to detecting a fire at a location in the facility 13, providing a warning and providing information to person(s) in the facility of a safe path out from the facility. Another safety example, is in response to detecting a fire and the location of the fire in the facility, providing information to the fire department indicating the existence and the location of the fire so resources may be efficiently directed to extinguish the fire. Still another health safety example, is in detecting a change in heart rhythm of a person that may be representative of a heart attack and knowing the location of the person in the facility, communicating with emergency medical personnel to direct them efficiently in the facility to the ill person. A similar health safety example, is sensing that a person has fallen, e.g., based on sight, sound, and so on, and that the person has not stood up, thus indicating a possible injury that requires medical attention, and then informing emergency medical personnel of the emergency and of the location of the person in the facility.

An entertainment example, is to sense who is a person in a room of the facility, knowing the preferred television viewing habits of the person, and turning on a television to a usually desired program for viewing by the person. Even another entertainment, sensing that a person is playing a game that is included in the apparatus 10 and sensing the heart rate of the person, the apparatus may change the level of difficulty or sophistication of the game to provide challenging play for the person while avoiding excess stress by the person.

The apparatus 10 may provide one or more security functions. Detecting unauthorized entry to the facility 13 is one example of a security function that may be carried out in one or more ways. One is to detect the unauthorized opening of a door or window or the breaking of a window or door, e.g., based on detected sound and/or vibration. Another is to sense the gait or other variable personal parameters, e.g., weight, odor, height, and so on, of an unauthorized person in the facility 13.

Information may be provided the apparatus 10 from various sources. For example, information may be available from the web or cloud to provide dimensions and other information regarding the facility 13. As was mentioned above, information may be obtained by the apparatus by mapping out the facility 13 and by monitoring for changes or learning resident's habits or facility patterns such as temperature, movements in the facility 13, and so on, and the apparatus may compare such information obtained, mapped, monitored, learned, and so on to current situations; and based on the comparison the apparatus may provide a response as well as update information and/or update a learning algorithm, which is discussed further infra. Automatic responses by the apparatus 10 provide one of the ways of acting on the monitoring and information obtained. For example, if a break-in is detected, lights (internal or external) and a siren (external or internal from the speakers in the device) may turn on, doors may close or open, pictures may be taken, etc. If a power failure occurs, lights built into the apparatus 10 and/or the respective indoor or outdoor portions 11, 12 thereof may be activated and/or other lights in communication with apparatus 10 may be activated. The information that is obtained may be stored in the cloud so it cannot be stolen or it can be stored locally. Alternative storage includes local personal computers, PAD (portable application device, e.g. those sold under the trademark IPAD), smart phones, etc., and multiple storage locations may be used in parallel.

FIG. 1B is a diagram of operative portions of an exemplary autonomous facility monitoring apparatus 10 (also referred to as "AFMA" or "apparatus") including respective indoor and outdoor apparatus portions 11, 12, which also are referred to collectively as "apparatus" 11, 12 and/or individually as apparatus 11 or apparatus 12 below, in accordance with embodiments of the present disclosure.

In the example of FIG. 1B, the apparatus 11, 12 monitors a facility 13 (e.g., a home, office, building, etc.) and the vicinity of the facility 13. The apparatus 11, 12 operates "autonomously" independently of a user. That is, the apparatus 11, 12 does not require the user to turn it on or off or even to reset the apparatus unless the user wishes to do so. The apparatus 11, 12 auto-arms for certain functions when the apparatus senses that all or specified people have left the facility 13 and auto-disarms certain functions when the apparatus 11, 12 senses one or more recognized persons entering or having entered the facility 13. The apparatus 11, 12 operates continuously without a user input other than those inputs inputted by the user at time of installation or those inputted by the user subsequently as and if they wishes. This eliminates unfortunate circumstances in which the apparatus 11, 12 is off when it should be on or vice versa. When the user is away or abroad, the apparatus 11, 12 may be programmed to know where or whom to contact in case of emergency without having to interrupt the user, e.g., during vacations, business trips, etc. unnecessarily.

The apparatus 11, 12 monitors the facility 13 by sensing at least one variable personal parameter (Vpp) or change in a personal parameter (e.g., by a sensor 14), and by detecting at least one environmental parameter (e.g., by a detector 15) that is either absolute or variable or change(s) in the environmental parameter. The variable personal parameter(s) may include, for example, a person's height, weight, posture, footsteps, footstep patterns, gait, odor, motion, motive patterns, voice, voice patterns, heartbeat, breathing patterns, iris, face, facial structure, fingerprint, moisture pattern responsive to perspiration and so on.

The detector 15 may be configured to detect one or more environmental parameters associated with a facility 13. The environmental parameter(s) may include, for example, pressure, temperature, heat, water, carbon monoxide, carbon dioxide, oxygen, spectroscopy values, ozone, electro-magnetic (EM) radiation, radon, Volatile Organic Compounds (VOC), smoke, humidity, vapor, emissions, wind, pollen, mold, motion, gas, chemical, etc. Various combinations of environmental parameters and personal parameters may be made, for example, such as changes in oxygen and carbon dioxide may indicate someone is breathing and may be used to identify a health condition or identify a person. The change in the environmental parameter(s) may include, for example, a change in the water level, humidity level, an increase in carbon-monoxide concentration, a hiatus in through-traffic, e.g., expectation that one or more people would be walking or moving through the local environment, etc. These are examples of parameters or information that may be compared to usual patterns that have been developed over time. In some embodiments, the apparatus can include a comparator that can be configured to compare a current detected environmental parameter with a stored environmental parameter and/or a current personal parameter with a stored personal parameter.

The apparatus 11, 12 may warn if the sensed or detected real-time parameters, e.g., as sensed or detected by sensor(s) 14 or detector(s) 15), exhibit a potential threat based on results of comparing the sensed and/or detected parameters with stored parameters (e.g. the sensed or detected parameters fall outside of an acceptable range of the parameters). The acceptable ranges of the parameters are dynamic and are learned dynamically by an algorithm (discussed in detail later), and the acceptable parameters and/or range(s) of parameters may change with conditions, such as time of day, season, the parameters themselves, etc. The stored parameters may include the variable personal parameters of a legal occupant(s), e.g., authorized occupant(s), of the facility 13, the environmental parameters, an acceptable range of change(s) of the environmental or personal parameters, or pertinent data useful in producing an accurate detection (e.g. user data such as output, health conditions, etc.). For example, after the apparatus 11, 12 of the current disclosure determines the layout of the room, e.g., a given room in which the apparatus is located or another room of the facility 13 and the apparatus senses an increased temperature in a an electrical outlet socket or in a bed, e.g., the occupant may have been smoking and fell asleep, that can lead to a fire if the temperature rise continues to increase, a notification is sent and an alarm is set-off or other pre-programmed sequence is instituted. The apparatus 11, 12 may include EM sensors (electromagnetic energy sensors, not shown) that can sense abnormal electromagnetic fields or dangerous electromagnetic fields in the facility 13. The apparatus 11, 12 can also sense electrocardiogram(s) (EKG) of people in the facility 13; for example, if the facility were a hospital and an electromagnetic field were suddenly sensed to have stopped or be abnormal (e.g., representing ventricular fibrillation), a warning may be sent to appropriate facilities, such as nursing staff, or if the apparatus 11, 12 were in a building other than a hospital and such sensing were to occur, an automatic call could be made to a call center 18 or to other relevant authorities 19.

Instructions can be provided through the apparatus 11, 12 on how to address a given situation. For example, what the best exit plan should be used in case of fire or how to perform cardio-pulmonary resuscitation (CPR) in case of cardiac arrest. Less significant but important changes may also be detected such as if someone has a non-life-threatening change(s) such as identifying a person that has an EKG that converts from sinus cardiac rhythm to atrial fibrillation or developing a fever which the system could identify and notify the user that they should seek appropriate help.

The initial variable personal parameters Vpp to be stored by the apparatus 11, 12 may be inputted by the user at time of installation or at a later time as the user desires and/or learned as the apparatus is used. As an example, if a user wishes to input a pattern of their footsteps for use in comparison with subsequently sensed real-time footsteps or patterns thereof, the user may place the apparatus 11, 12 at a desired location and walk about in the facility 13 for a period, e.g. from about 10 to about 30 seconds or other amount of time that is sufficient to generate a pattern of gait specific to the user. The user may walk up and down a staircase, across a living room or multiple different rooms, from an outdoor gate to the middle of a kitchen, etc. The apparatus 11, 12 detects gait and normal changes in the gait and learns the gait and normal changes for future reference. If a person breaks a leg and wears a cast, the apparatus will learn the new pattern of walking, for example. The user may input more than one set of patterns for a more accurate recognition by the apparatus 11, 12 (e.g. patterns of footsteps barefoot, while wearing loafers, sneakers, or dress shoes, and so forth). The user may input not only many of their parameters or patterns of the parameters, but also parameters or patterns of other person(s) to be stored in the apparatus 11, 12. The more parameters inputted, the greater the probability of an accurate determination, e.g., to determine whether or not an individual in the facility 13 is authorized to be there. The sensors 14 may include sensors for odor (discussed further infra), which may be very sensitive; odors can pervade multiple rooms. Odor information personal to respective individuals may be sensed and stored by the apparatus 11, 12, and when odor sensing is coupled with gait recognition improvement in accuracy of person recognition may be improved.

Also, knowing the schedule (information) of individuals helps the apparatus 11, 12 to recognize if the person should be in the facility 13 at a particular time or duration of time. If no one is expected in the facility 13 and a sensor 14 has unrecognized input, a message is sent to the user, call center 18, authorities 19 and/or an automated sequence is triggered, e.g., to sound an alarm, or other response.

Environmental parameters or acceptable range of change(s) in the environmental parameters may be inputted by the manufacturer or by the user at the time of installation or subsequently. The manufacturer may input, for instance, the government Environmental Protection Agency's maximum contaminant level for lead in the air or asbestos in drinking water (e.g. 7 MFL greater than 10 μm in length of drinking water) in the memory (discussed further infra) of the apparatus 11, 12. The apparatus 11, 12 will automatically query the relevant governmental values to see if they have changed and update the information used for comparison.

The user may place the apparatus 11, 12 at one desired location in the facility 13 or may move it to several different locations; and at the location(s) the user may employ the apparatus 11, 12 to scan the facility 13 including the dimension(s), size(s), location(s), arrangement(s) of the facility 13, the contents and the vicinity of the facility 13. For instance, an omnidirectional camera such as a 180-degree or 360-degree camera may capture one or more image(s) of the facility 13, or an ultrasound sensor (discussed further infra) or a laser scanner (discussed further infra) capable of detecting parameters without having to visually recognize the parameters may map a portion or the whole of the facility 13. Camera and ultrasound/laser or other detector data may be combined to improve the accuracy of a map of the facility 13 for optimized monitoring and control functions. The captured and/or mapped images of the facility 13 will be inputted and stored automatically or by the user to be compared with the subsequently detected real-time parameters. The various mentioned parameters may be updated locally by the apparatus 11, 12 as parameters change or may be updated from an internet/cloud information bank (not shown) as parameters change, such as if the EPA changes accepted levels.

User data may be inputted to the apparatus 11, 12 via a user device such as a personal computer 23, a game box 24, a digital television 25, a mobile phone 26, a vehicle navigation device 27, a tablet computer 28, a digital watch 29, PAD 31, and so on, e.g., as operated by a user of the apparatus 11, 12. User data also may be inputted via an infra-red (IR) sensor, e.g., to measure temperature of the user, inputted from the internet from a site identified by a user, for example, who operates a user device 17. The user data may include, for example, any information pertinent or useful in producing an accurate sensing or detecting using sensors 14 and/or detectors, exemplary user data may be healthy conditions, daily activity information, etc. For example, a user who is usually in an atrial fibrillation condition that does not require emergency treatment may be recognized by other personal parameters such as gait or odor; and since the apparatus 11, 12 would correlate the atrial fibrillation with such user, it would not cause an indication of an emergency condition that would require sending a notification to an emergency authority, etc.

Input(s) to the apparatus 11, 12 may be added remotely from a central information bank (not shown) or locally and may be personal/facility specific or general. Infrared (IR) signal transmission may be used to input data such as from remote control units (not shown) and also be used as an output for IR controlled devices, such as televisions, which also may be controlled by audio commands from anywhere in the room or facility 13. An audio output device, e.g., a speaker, can be used to provide information to the user from multiple sources, including the internet, notifications concerning occurrences in the facility 13, e.g., intruder detection, incoming telephone call, fire alarm, alarm clock function, and so on. For example, the apparatus 10, 11, may include functions to notify the user of a pending significant detrimental weather event or other events where the information is available on the internet or through other sources.

The user may request that certain music or certain video is to be played, which is then played through the speakers (discussed further infra) and/or on the display (discussed further infra); and, as the apparatus 11, 12 may know the location of the user, the music or video can follow the user to different locations in the facility 13 wherever the user goes so as not to interrupt their listening or viewing, even into other rooms, if the rooms are suitably equipped with speaker(s) and display(s). In an embodiment, detection of the user movement and location is automatic, e.g., based on gait, odor or in response to other sensors 14.

The apparatus 11, 12 may provide information to the user on demand by the user. Such information may be received or obtained from the internet or other sources, e.g., stock quotes, weather information, and so on. The apparatus 11, 12 may respond to user's voice inquiries or can be queried directly by keyboard input or other input methods.

The apparatus 11, 12 compares real-time detected parameters with the stored parameters. The apparatus determines whether results of such comparison predicts a possible occurrence of an undesirable or negative event (e.g. water leak, fire, power outage, flood, injury, death, theft, burglary, etc.) and/or provides an output representative of predicting of an undesirable event. In some embodiments, the apparatus outputs a negative output indication when a stored personal parameter and a detected personal parameter do not correspond with a respective range of values stored in a memory. In some embodiments, the negative output indication can cause the apparatus 11, 12 to restrict access to at least one of a location in the facility, an information system, and electronic data.

In the cases of variable personal parameters, the prediction may be based on determination whether there is a match between the detected real-time variable personal parameters and the stored variable personal parameters. A match may occur when the detected real-time parameters have the same distinctive attributes unique to the user or other person(s) whose parameters have been stored in the apparatus 11, 12. For instance, a person's face can be identified by recognizing facial structures of the person. Hence, if the detected real-time face has the same facial structure as a stored facial structure, it may declare a match. Other personal data such as height, girth, etc. can also be determined by measuring directly (visually) or computed from the person's parameters relative to known points, such as, known points on a wall before which the person is standing. A match may also occur when the detected real-time parameters fall within an allowable variation range pertaining to the variable personal parameters at issue. For instance, a person's pattern of footsteps varies depending on the person's mood, footwear, load, urgency, etc. The apparatus 11, 12 takes into account such variations and produces an output responsive to the occasion (e.g. the footstep pattern may belong to A with variations possibly due to A wearing snow boots). If the apparatus 11, 12 determines that the detected footsteps fall within the acceptable variation of the footsteps of stored footsteps/patterns, it may declare a match. However, in cases of an iris or blood patterns therein which are prone to change constantly, the apparatus 11, 12 accounts for such changes in monitoring the parameters. Hence, if a detected iris (or the blood vessel patterns therein) is 100% identical to a stored iris, then the apparatus 11, 12 deems the detected iris or the blood patterns therein as a mismatch and considers that either the iris image was stolen or the apparatus 11, 12 is being hacked, and then, produces an output to that effect. Thereafter, the apparatus 11, 12 alerts the user by sending the output to a user device (e.g. a personal computer 23, a game box 24, digital television 25, a mobile phone 26, vehicle navigation device 27, tablet computer 28, watch 29, PAD 31, etc.), and may ask for user instruction (e.g. whether to call certain authorities 19, to disregard, etc.), and/or may activate automation capabilities in the facility 13 and/or alert a call center 18 or relevant authorities 19 such as a local police station, fire station, "911" or other emergency operators and so forth. The user and facility data may be sensitive and/or confidential and so the apparatus 11, 12 includes techniques to determine possible digital hacks and protects against them. Different privacy modes for different people such as users, guests, etc., may provide different respective levels of access for different people of the device.

With regard to environmental parameters, the apparatus 11, 12 may determine, based on results of comparing detected environmental parameters or changes with the stored environmental parameters or acceptable range thereof, whether there is an anomaly in the detected environmental parameter(s) or change in the environment parameter(s). As an example, if the current supplied to the facility 13 is 0 ampere, then the apparatus 11, 12 determines that there may be a power outage and produces an output to that effect. The apparatus 11, 12 of the current disclosure is supplied with battery back-up (discussed further infra) and can transmit data via cellular as an option. Thereafter, the apparatus 11, 12 alerts the user by transmitting the output to a user device, asks for user instruction, activates automation capabilities in the facility 13 and/or alerts a call center 18 or relevant authorities 19 among others. In another example, if the apparatus 11, 12 determines the water level in a tank or water pressure in a pipe is below the stored acceptable range and/or the humidity level of the facility 13 is too high, the apparatus 11, 12 produces an output indicating a possible water leak, structure damage due to the water leak, etc. Thereafter, the apparatus 11, 12 alerts the user by transmitting the output to a user device, asks for user instruction, activates automation capabilities in the facility 13 or alerts a call center 18 or relevant authorities 19 among others.

The apparatus 11, 12 may be located anywhere within or in the vicinity of the facility 13 (e.g. on a wall, floor or ceiling, placed on a table, and so on. Regarding the outdoor apparatus 12, it may be located on an outside wall or roof of the facility, on a tree, on the ground, and so on. The outdoor apparatus 12 may include a weather-proof cover or enclosure.

The at least one sensor 14 refers to a device that detects variable personal parameters (Vpp) and a change(s) in the personal parameter in the context of the present disclosure. The at least one detector 15 refers to a device that detects environmental parameters and a change(s) in the environmental parameters in the present disclosure. It will be appreciated that the user devices 17 of FIG. 1B are exemplary only and may include a suitable machine, equipment, and the like that are currently available and/or may become available in the future. The user device(s) 17, the apparatus 11, 12, the call center 18, the automated facility equipment 18*a* and/or relevant authorities 19 are in electrical communication with one another via the communications system 16 including, for example, a wired connection 32, Wi-Fi 34, Internet 36, mobile telephone 38, wireless device 40, Bluetooth™ device 42, as well as other devices 43, such as, for example, a mobile device, carrier current (carrier current refers to use of electrical power lines, e.g., from the utility company or within the facility 13 to carry electrical signals, such as, for example, digital signals, in addition to electrical power transmission), panic button, and so forth, which may be currently available or become available in the future.

Figure 2:
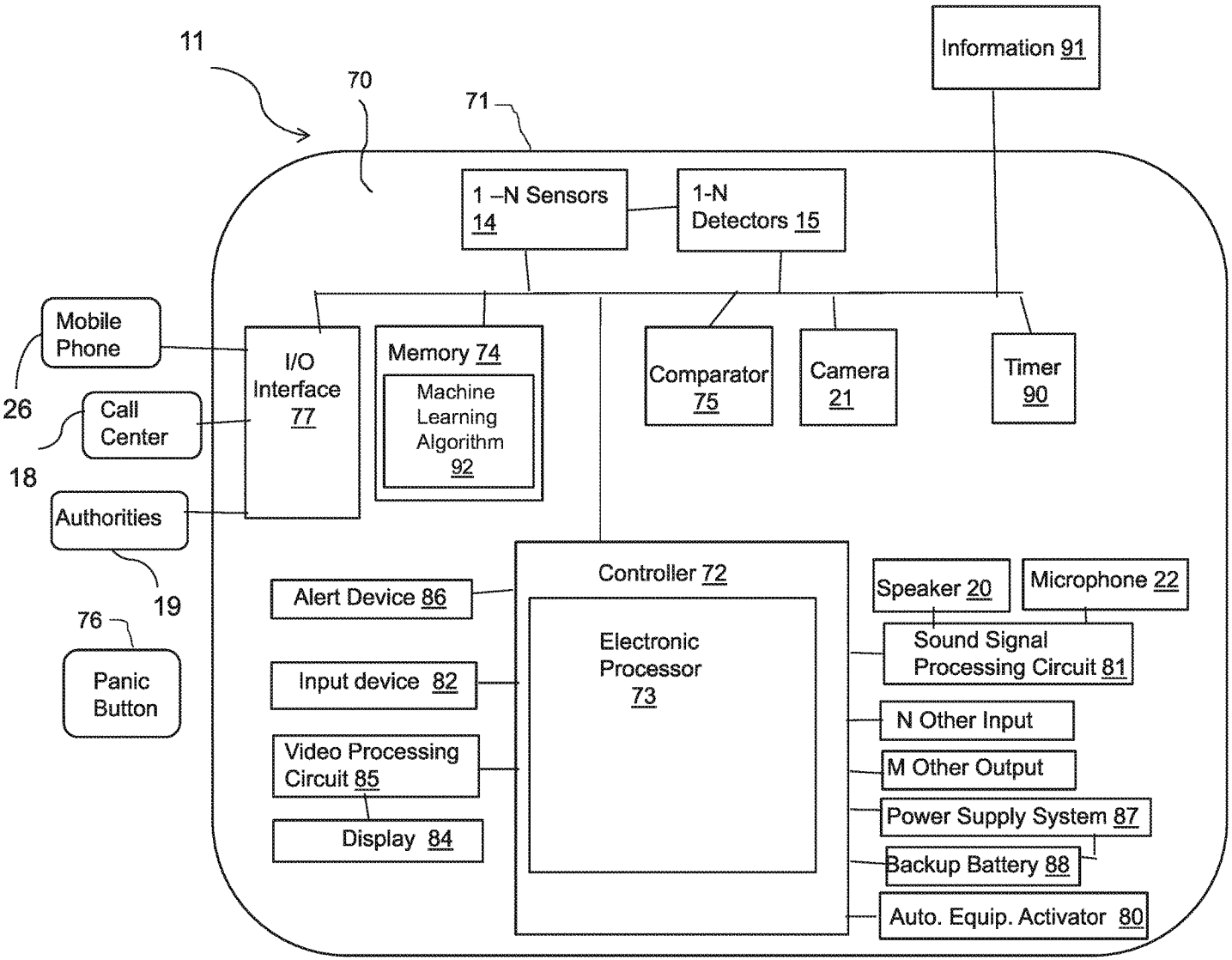
FIG. 2 is a schematic block diagram of operative portions of an autonomous facility monitoring apparatus, illustrating a controller with input/output connections with respect to several subcomponents or subsystems.

FIG. 2 is a schematic block diagram as a system diagram of operative portions of an exemplary indoor facility monitoring apparatus 11 in accordance with embodiments of the present disclosure.

As is shown in FIG. 2, the apparatus 11 includes circuitry and components, collectively designated 70. Many, if not all, of the circuitry and components are housed in a single container, package, box, case, etc. 71. A controller 72 including a processor 73 receives inputs representative, for example, of information, values, etc., received from sensor(s) 14, detector(s) 15, from the communications system 16, e.g., from the internet or other source of inputs, from user devices 17 and/or from various components shown illustrated and/or described herein, some of which are illustrated in FIG. 2. The controller 72 including the processor 73 provides outputs to various circuitry and components 70 and/or to others not shown to carry out the functions of the apparatus 11, some of which functions are described in this disclosure. The controller 72 and processor 73 may be a single or several electronic devices, including, for example, microprocessor, digital circuitry, logic devices and/or circuitry, and so on, which are known in the field of electronics and/or which may come into existence in the future.

A memory 74, such as a solid-state memory, disk drive memory, or other memory device or system, contains computer program code or instructions for the controller 72 to carry out the various functions and operation of the apparatus 11. The memory 74 may include a non-transitory memory containing such instructions and may include a memory portion for receiving and storing various data from and for use by the controller and/or by other components of the apparatus 11 as apparatus 11 carries out its functions. In some embodiments, the memory 74 can be configured to store detected environmental parameters and sensed personal parameters.

A comparator 75 receives the real-time detected variable personal parameters (a first incoming data) or change(s) of the parameter(s) (inadvertently or collectively referred to as a second incoming data) and compares the first incoming data with the stored variable personal parameters (a first stored data). The comparator 75 may be a separate component of the apparatus 11 or may be a set of instructions stored in the memory 74 and carried out by the processor 73 of the controller 72. The comparator 75 also receives the detected real-time environmental parameter(s) or change(s) of the parameter(s) (individually or collectively referred to as a second incoming data) and compares the second incoming data with the stored environmental parameters and/or acceptable range of the environmental parameters (a second stored data). The comparison results by the comparator 75 or by the controller 72 carrying out the comparison function(s) may be acted on by the apparatus 11 if necessary. Such acting may be, for example, as a result of a determining that there is a high temperature or a freezing temperature at a location in the facility 11; and in response to such determining, the controller may notify the user via mobile phone 26, may notify a call center 18 to send a repair person, may notify fire department if high temperature is indicative of fire; and so on.

The apparatus 11 has multiple functions to trigger a panic notification. One example is a panic button 76 that can be pressed by the user to provide an input via input/output (I/O) circuitry 77 to the controller, which may respond by sending a notification to an appropriate authority 19, e.g., police department, fire department, etc. Another example is for the user to speak a designated sequence of words, e.g., "emergency, emergency, emergency". The apparatus 11 will recognize that the sequence of these three commands without any speech in-between is a panic button situation and the apparatus responds appropriately. This sequence of words command ordinarily would not be used in normal speech, so a panic button result would not be triggered during normal conversations.

The controller 72 is configured to control the functions and operations of the apparatus 11 in accordance with the present disclosure. The controller 72 includes an electronic processor 73, as mentioned above, e.g. a CPU, etc. The controller 73 may execute program code necessary in operation of the apparatus 11 whether the code is embedded or supplied via electrical communication from a remote operation center (not shown), server (not shown), cloud (36) or the like, or instructions stored in the memory 74. The controller 72 may contain or be a field programmable gate array. The computer program instructions or software for the controller can be updated remotely and/or locally. The controller 72 may create an output based on the comparison results mentioned above, based on other relevant information (e.g. the previous user instructions to similar situation(s), etc.) stored in the memory 74, or based on information from the web (e.g., emergency weather situation), among others. As mentioned above, the memory 74 may include a non-transitory memory for storing computer program code instructions and a transitory memory for storing data/information. The output provided by the controller 72 may include a prediction, for instance, of a possible burglary if the comparison results indicates unmatched patterns of footsteps, odors, voice patterns or such. In response to such a prediction output by the controller 72, the controller alerts the user by sending the output as a notification to a user device (e.g. a personal computer 23, a game box 24, digital television 25, a mobile phone 26, vehicle navigation device 27, tablet computer 28, watch 29, eye glasses 30 (e.g., that have a display or other notification function, PAD 31, or other wired or wireless device, etc.). Such notification may ask for user instruction (e.g. whether to call certain authorities 19, to disregard, etc.), may activate automation capabilities in the facility 13, e.g., to sound a loud alarm or siren, to flash lights, to adjust a thermostat, and/or may alert a call center 18 or relevant authorities 19 such as a local police station, fire station, 911 operators and so forth.

The apparatus 11 may have an input/output interface 77, which transmits and receives data from the sensor 14, detector 15, information from other sources, a user device 14, a call center 18, relevant authorities 19, automation equipment activator 80, and the like, for example, via wired connection 32, Wi-Fi 34, Internet 36, mobile device 38, wireless device 40, Bluetooth™ device 42, carrier current (not shown), infra-red (IR) (such as from a remote control unit) and so forth. The automation equipment activator 80 may be, for example, a switch or circuit that turns on a blower to circulate cooling or heating air in the facility or that turns on a sprinkler system to douse a fire, and so on. The apparatus 11 may include a sound signal processing circuit 82 that processes audio signals transmitted or received from the I/O interface 77. The sound signal processing circuit 81 may be operatively coupled to a speaker 20 and a microphone 22. The speaker 20 can be used as an alarm as well as for communicating with other people, responding to a query or listening to music, etc. The microphone 22 can be used to communicate to other people, ask a query, provide instructions or commands, input data to be used later (like a shopping list), etc. For example, a shopping list could be inputted through voice and retrieved through a mobile device (e.g. mobile phone 26, vehicle navigation device 27, tablet computer 28, watch 29, glasses 30, PAD 31) while the user is in a store, for example, while shopping. The information, e.g., a shopping list, retrieved may be initial audio or may be text obtained via speech to text conversion, and the text may be viewed on a portable device, e.g., a smart phone—and items on a shopping list conveniently could be viewed and checked off as they are "picked up" for purchase.

The sound system, e.g., including the microphone 22 and the sound signal processing circuit 81, may receive sounds through the microphone and detect an event based on the sounds. For example, a sound of breaking glass may be detected and understood to identify that a break-in is occurring. Upon recognizing a break-in occurring, the apparatus 11 may activate a notification called in to appropriate police authorities. The sound system may hear and understand ringing of a doorbell or the apparatus 11 may be directly coupled to receive a signal upon pressing of a doorbell; and the apparatus may alert authorized person(s) in the facility or remotely located that someone as at the door. If a speaker 20 and microphone 22 is included in the doorbell or at the door, for example, the user can communicate (two-way) with the person at the door audibly through the apparatus 11. If a camera 21 is built into the doorbell or is at the door, the apparatus 11 could view an image of a person at the door and could determine whether that person is recognized, e.g., an image of that person may be stored in the memory 74 and using facial recognition technique the apparatus 11 may determine wither or not the approaching person is recognized. Moreover, person approaching the door could also be determined by footsteps (gait), odor and other techniques previously described even before they ring the doorbell; the patterns can be categorized as recognized if the patterns are within the parameters that already had been stored, in the apparatus or unrecognized if they are not. If the person is recognized and the program or operation of the apparatus 11 is such they are permitted entry, e.g., the door could automatically be unlocked or opened. In case the user wishes to communicate directly with the call center 18 or relevant authorities 19 regarding a possible occurrence of an undesirable event, the user may enter information (e.g. phone numbers of the call center 18 or the authorities 19) necessary to make such communication, using the input device 82 by typing or touching the numbers or alphabets included in the input device, and speak directly to the call center 18 or relevant authorities 19 via the speaker 20 and microphone 22. The user may also use one of various methods of voice recognition and simply say whom they want to contact.

Since the apparatus 11 senses where people are in the room in which the apparatus is located (or possibly in other rooms in the facility 13), the display 84 (or several displays) may in a sense follow them, e.g., being turned on or off by the apparatus based on location of the people, so they do not have to get up or move to get visual information such as time, temperature, team scores, etc. This "follow" function is useful when the person desires to have video communication with someone else; using the camera(s) 21 and a display 84, two-way video communication is possible. Furthermore, since the location of a person within the facility 13 is determined, anyone wishing to communicate with them can directly communicate with them efficiently and privately without paging the entire facility 13 or even calling them via mobile phone 26 or paging them.

Information indicating the location of a person in the facility may be used by the apparatus 11. For example, if a person in the facility has a heart attack, the apparatus 11 may sense this, may provide that information to another person in the facility, and may provide via a speaker 20 and display 84 information on how to carry out cardiopulmonary resuscitation (CPR). The apparatus 11 may sense or detect other incidents, events or occurrences and provide information indicating the same and informing how to address the same.

Text to speech and speech to text capabilities of the apparatus 11 can further improve the communication. In the above example if a person is giving CPR and instructions are available via text, the text to speech function could provide audio instructions. Another example is if the user is communicating orally to someone who can only receive alphanumeric information, the voice information is translated to text and transmitted. Similarly, if speech is received, the apparatus 11 can display the translated speech to text. The use of apparatus 11 as a shopping tool has been described above.

The display 84 may show/display parameters detected in real-time and/or other information such as an output created based upon the parameters detected real-time, stored parameters, comparison result(s), answer to a query, information available from other sources such as the web and/or a prediction of a possible occurrence of an undesirable event(s). The images may be processed by a video processing circuit 82, which is operatively coupled to the display 84, to provide such prediction, for example. In response to a given prediction, the apparatus 11 may alert the user by transmitting the output to the user device 17, ask for a user instruction, activate automation equipment activator 80 in the facility 13, and/or alerts a call center 18 or relevant authorities 19 via an alert device 86 and so forth.

Information received by the apparatus 11, e.g., from the camera 21, microphone 22, and/or other biologic sensors 14 may be analyzed by the controller 72 to determine various results, e.g., whether a person is being honest, whether a person is asleep, and so on. For example, when a person is playing a game, the apparatus 11 may detect/analyze whether the player is honest or is cheating. When a television is on in a room, upon detecting that the viewer is asleep, the apparatus may turn off the television.

In an embodiment the apparatus 11 may control a projector to show images and may determine where to project the images, e.g., on a wall that can be observed by the viewing person or even on the on the ceiling when the user is in bed.

The apparatus 11 may be operatively coupled to a power supply 87 and a backup battery 88; these provide power to the apparatus to monitor the facility 13 without interruption. For instance, if the power supply 87 were interrupted, exhausted, sabotaged or malfunctioning, the backup battery 88 would become activated and supply power to the apparatus 11. The controller 72, in turn, creates an output indicating the power interruption, exhaustion, sabotage or malfunction. Thereafter, the controller 72 alerts the user by transmitting the output and asks for a user instruction, activates automation equipment 80 in the facility 13, e.g., for security purposes, and/or alerts the call center 18 or relevant authorities 19, and so forth. Information based on detectors 15 and information from external sources (Internet 36) will be provided as to the cause of the power failure, whether it is external (power failure from the power company as determined from the Internet or directly from power company through automatically contacting the power company) or internally as detected from detectors 15 or observations in the facility 13. The power supply system typically will also include carrier current capabilities to receive control commands and to control external devices. The apparatus 11 may further include a timer 90, which is operatively coupled to the components of the apparatus 11 in order that each component performs in accordance with the appropriate time periods suitable for preferred performance. For instance, the timer 90 may be connected to sensors 14 detecting footstep patterns to allow the detectors a sufficient time (e.g. 10-30 seconds) to detect accurately. The timer 90 also may be used to detect delays between signals to be used, for example, to triangulate between subsonic signals received from footsteps. It may be used to synchronize various devices as well as alarm or perform various pre-programmed or pre-described functions with time or duration triggers or other triggers. The timer 90 also may be used to detect delays between signals to be used, for example, to triangulate between subsonic signals received from sensed footsteps. Amplitude, frequency and/or other parameter differences from the respective sensors (different sensors) may be used to triangulate, too.

The apparatus 11 may include a connection to the internet, e.g. to the worldwide web, as is shown at 91. Such connection may provide input information to the apparatus 11 and/or may provide output information from the apparatus 11.

The apparatus 11 may further include a machine learning algorithm 92 which may be stored or contained at least partly in non-transitory memory portion of memory 74 or as a separate device pluggable to the apparatus 11. The machine learning algorithm may also be stored in the cloud 36 for back-up or execution. The controller 72 is operatively coupled to perform the steps of the machine learning algorithm 92. The machine learning algorithm 92 improves the performance of the apparatus 11 by aiding the controller 72 in operating and controlling the functions and operations of the apparatus 11. For instance, the machine learning algorithm 98 may learn new parameters and may update the stored information in the memory. Also, the controller 72 may be in electrical communication with a remote operation center (not shown) and transmit information including the detected data, stored data, user instructions, new patterns or parameters learned by the machine learning algorithm 92, and all other data preceding the transmission. The remote operation center (not shown) can receive and analyze the information received, improve or update the machine learning algorithm 92 and transmit the analysis and the improved or updated machine learning algorithm to the controller 72, which, in turn, automatically downloads to and saves the improved or updated machine learning algorithm in the memory 74.

The outdoor apparatus 12 may include similar components and operate in a similar manner as described above with respect to the indoor apparatus 11. Hence, the detail and description of the outdoor apparatus 12 will be omitted herein. It will be understood, however, that the outdoor apparatus 12 may also include sensors 14 or detectors 15 suitable for outdoor security and environmental monitoring such as gate detector, garage door detector, notification that mail has been delivered or removed and so forth. Outdoor operation has some environmental challenges due to weather and environmental constraints but also has advantages in that it can be powered more readily by solar. An additional feature of the outdoor apparatus 12 is that it may include a Global Positioning System (GPS), accelerometer or 3-axis gyroscope that can transmitted location and motion information via various communications methods, such as those disclosed herein, so the apparatus 12 can be located in case it falls or is stolen in which case the thief's location may be determined.

A unique example of operation of the outdoor apparatus 12 is by combining weather information received via the Internet together with outdoor temperature and/or precipitation detectors 15, the need to turn on driveway snow/ice melting apparatus (system) may be determined. The apparatus 12 in such case may turn on the melting system automatically, thus providing for safe passage for persons or vehicles on driveway, walkway, stairs, etc.

Figure 3:
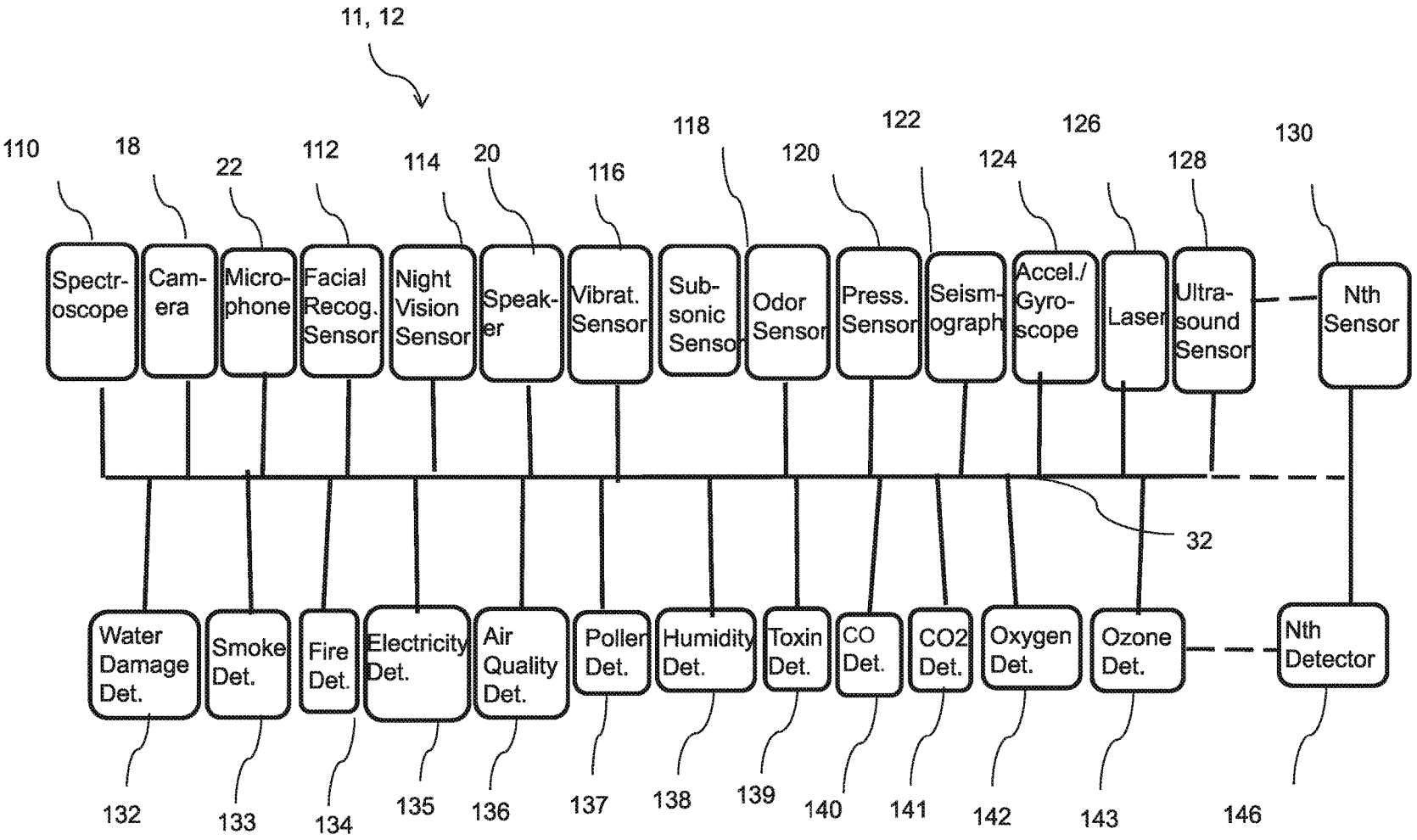
FIG. 3 is a schematic diagram of an exemplary bus arrangement in communication with sensors and detectors of the autonomous facility monitoring apparatus.

FIG. 3 is a diagram of an exemplary bus 32 in electrical communication with the at least one sensor 14 and the at least one detector 15 of the indoor apparatus 11 in accordance with embodiments of the present disclosure. The apparatus 11 may include one or more sensors (some of which are mentioned above) including but not limited to a thermal infrared camera or spectroscopy type camera 110, facial recognition sensor 112, night vision sensor 114, vibration sensor 116, e.g., a seismic sensor, odor sensor 118, pressure sensor 120, seismograph 122, gyroscope 124, laser 126, ultrasonic sound sensor 128, and other sensors, as may be desired for use in the apparatus 11. For example, subsonic sensor (not shown) and a personal voice pattern recognition device, which may include the microphone 22 (FIG. 1) together with voice recognition software stored in and used by the memory 74 and controller 72 may be included in the apparatus 11.

The apparatus also may include apparatus and/or software to determine whether a user device 17, such as a mobile phone 26, PAD 31, Personal computer 23, etc. is in the vicinity or in the facility 13.

As shown in FIG. 3, the apparatus 11 may include one or more detectors 15 connected to the bus 32. The exemplary detectors include, but not limited to, water damage detector 132, smoke detector 133, fire detector 134, electricity detector 135 (e.g., to identify occurrence of an under or over voltage applied to the apparatus, and so on), air quality detector 136, pollen detector 137, humidity detector 138, toxin detector 139, carbon monoxide detector 140, carbon dioxide detector 141, oxygen detector 142 and ozone detector 143. Other detectors to be included may be spectroscopy, subsonic, voice, vapor, mold, motion, chemicals, Wi-Fi in vicinity, electro-magnetic (EM) radiation, volatile organic compounds (VOC), radon detectors and the like. It will be appreciated that the sensors 110-130 and/or detectors 132-146 of FIG. 3 are illustrative examples only and they may include any hardware, software, and/or a combination thereof that are available currently or will become available in the future.

The functions of respective sensors 14 and detectors 15 are shown in FIG. 3. Some additional functions include one or more of the following, and others may be included, as well:

The fire detector 134 may include detection via camera, whereby the controller 72 may analyze an image representing fire; or the fire detector 134 may include a heat detector that produces an output representing fire. Moreover, a smoke detector may be included as part of the fire detector 134. The detectors 15 may include carbon monoxide detectors, carbon dioxide detectors, oxygen detectors, sub-sonic sound, motion or vibration detectors, spectroscopy detection services, voice detector devices, ozone detectors, electromagnetic radiation detectors, and so forth. Still further, the detectors 15 may include radon detectors, vapor detectors, pollen detectors, mold detectors, motion detectors, volatile organic compound (VOC) detectors, and/or other chemical detectors.

The sensors 110-130 may communicate with one another and act in tandem with one another to produce an accurate recognition and/or useful information for the apparatus 10 (including the indoor and outdoor portions 11, 12 thereof). For example, information sensed by a sensor with visual capability (e.g. night vision sensor 114) and from one or more sensors without visual capability (e.g. thermal infrared spectroscopy 110, laser 126, ultrasound sensor 128, etc.—an nth sensor is shown representing that there may be other sensors in addition to or instead of those that are itemized in the drawings and described herein) may be communicated among the sensors 110-130 and used in combination thereof so that an action by the apparatus 10 would be based on individual data or in combination for a synergistic effect. As an example, when a person enters a floor or a room in which the apparatus 11 is not installed the person still may be detected and even recognized based on the detection of the person's footsteps or gait may get detected simultaneously by a vibration sensor 116, pressure sensor 120, or seismograph 122, a gyroscope 124, or based on other personal parameters such as sensed by odor sensor 118, voice pattern recognition device/software, or even by recognition of a user's personal mobile phone/PAD/PC, etc. or the like; such information may be used in combination to produce an accurate detection and/or recognition of the person entering the room. Many visually based systems require placing a device in every location in a facility where visual detection is desired. Under the present disclosure an apparatus 11 in one room may be used to sense and possibly to identify a person in a room where the apparatus is not physically located.

The detectors 132-146 may also communicate with one another and act in combination. An nth detector is shown representing that there may be other detectors in addition to or instead of those that are itemized in the drawings and described herein. In the example of a water leak, the water damage detector 132 detects a low water level and the humidity detector 138 may detect an increase of humidity level in the facility 13. The environmental parameter and the change detected by those detectors 132-146 are used in combination to produce a more accurate outcome predicting and to detect a water leak and/or structure damage, thereby allowing the user to take appropriate measures in response to the outcome. The apparatus can also trigger certain responses based on the physical area where an input is coming from, such as using a microphone or other sound/audio detector to determine the breaking of a window and which window was broken and to couple that information with footsteps to determine whether a person has entered the broken window and whether that person is authorized to be in the facility. For example, a burglar would be unauthorized but a person who lives in the facility and forgot a door key may break a window to gain entry.

Further, the sensors 110-130 and the detectors 132-146 may communicate with one another for a better recognition of a situation. As an example, a scenario in which the pressure sensor 120, the seismograph 122 and/or the gyroscope 124 have detected no movement in a bedroom for a prolonged period and knowing that a person is in the bedroom, would tend to indicate that the person is asleep. If the garage door detector (not shown), door detector (not shown) or gate detector (not shown) then reports an open condition, the apparatus can notify the user (wake up the person with an alarm or provide an audible message, for example) to close the open door or gate. If a person is not in the facility, such "open" condition may be notified to the user by anyone of a number of user devices, such as mobile phone 26, PAD 31, PC 23, etc., and the user may use the user device to send a signal to close the door, gate, etc. Moreover, the apparatus 10 may automatically close doors, gates, etc. if no person is detected in the facility or may open the appropriate door, gate, etc., upon detecting arrival of an authorized person.

The odor sensor and biologic sensors may be used to sense a medical condition of a person in the facility. For example, a person having a high body temperature indicating illness may be sensed by an infrared sensor, or a noise representing distressed breathing may indicate a medical emergency. In such case, the apparatus 10 may notify a call center, police or fire department to indicate the issue and to request emergency personnel. Furthermore, the apparatus 10 may recognize a deceased person in the facility, for example, in response to not receiving an input representing movement of a person, on the one hand, but sensing an odor, on the other hand. The odor sensing feature of the apparatus 10 may be used not only for identifying a person but also may identify a gas leak, smoke/odor emitted prior to a major fire beginning, and so on; and the apparatus may provide an alerting notification to fire department or other appropriate authority to address the emergency before it would get out of easy control.

In addition, the indoor apparatus 11 and the outdoor apparatus 12 may be used in conjunction to produce a more accurate detection. For instance, in the example of burglary detection, the footsteps detected by the gyroscope, subsonic, seismograph, etc. of the outdoor apparatus 12 from the gate to the entrance door of the facility 13 may be used in combination with the footsteps detected by the similar sensors of the indoor apparatus 11 within the facility 13 to produce a more accurate recognition of footstep patterns. These can be used to confirm that the footsteps are unrecognized (thus, likely a burglary is occurring), and using triangulation the apparatus 11, 12 can determine the path the intruder is taking and can notify authorities of where the intruder is or is expected to be going and they can later be used to locate and/or to identify the intruder. Multiple seismic sensors may be used to determine where a person is through triangulation, based on delays, amplitude, vibration and other data.

The sensors 14 and detectors 15 of an outdoor apparatus 12 may be connected to a bus and used in a manner similar to that described above with respect to the bus 32 of the indoor apparatus 11. For brevity such additional bus is not further described in detail.

The outdoor apparatus 12 may include, in addition to the sensors, detectors and bus mentioned above with respect to the indoor apparatus 11, sensors and/or detectors appropriate for outdoor monitoring outdoor events, such as a garage door detector, a gate detector, a fence detector, mail box detector to monitor mail going into or out of mail box, etc. Further, a camera like the camera 18 (FIG. 3) may be included as a detector of the outdoor apparatus 12 and may be used to photograph/video images of persons approaching or leaving the facility. Such images may be used to verify the identity of an unauthorized intruder, e.g., a burglar. Moreover, images of the facility from the outside may be analyzed by the controller 72 to determine whether there is a fire in the facility and the location of the fire and/or to identify the occurrence and location of damage to the facility, e.g., due to a tree falling; and may provide appropriate notification of the same so that the resident of the facility or emergency personnel may be directed promptly to the damage, fire, and so on.

Figure 4:
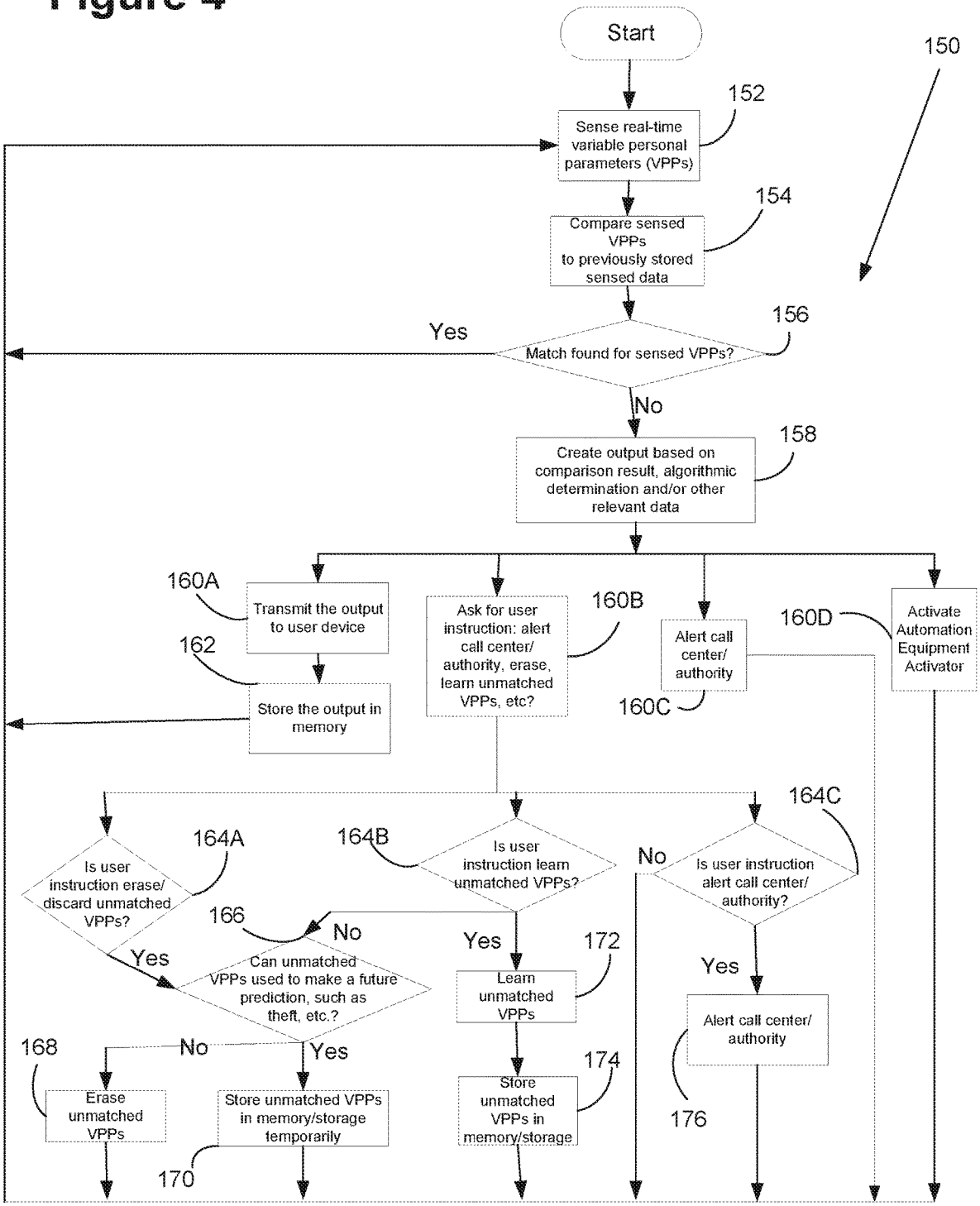
FIG. 4 is a flow chart illustrating an exemplary control method with respect to the sensors of the autonomous facility monitoring apparatus.

FIG. 4 is a flow chart illustrating an exemplary control method 150 with respect to the sensors 110-130 in accordance with the present disclosure. FIG. 4 illustrates exemplary steps that may be executed by the controller 72 of the apparatus 11, 12 with respect to variable personal parameters (Vpp). A person having ordinary skill in the art would be capable of writing in a reasonable period of time appropriate computer program code to be executed by the controller 72 and various other parts of the apparatus 10 to carry out the steps for operation of the apparatus. More particularly, the method 150 of FIG. 4 illustrates a control method for autonomous facility monitoring of variable personal parameters (Vpp) sensed or monitored by the sensors 110-130 and/or other sensors 14. Beginning at step 152, at least one sensor of the apparatus 11, 12 senses real-time variable personal parameters of an animate being entering or moving around the facility 13 and the real-time variable personal parameters are inputted to the comparator 75. At step 154, the comparator 75 compares the real-time variable personal parameters with the stored variable personal parameters (the first stored data) stored in the memory 74.

At step 156, the comparator 72 determines whether there is a match between the detected real-time parameters and the first stored data. A match may occur when the detected real-time parameters have the same distinctive attributes unique to the user or other person(s) whose parameters have been stored in the apparatus 11, 12. For instance, a person's face can be identified by analyzing facial structures of the person; if the detected real-time face has the same facial structure as a stored facial structure, it may be a match. A match may also occur when the detected real-time parameters fall within the allowable variation pertaining to the variable personal parameters at issue. Steps may be taken to confirm the match—for instance, by using a footsteps pattern (gait) analysis. For example, a person's pattern of footsteps (gait) that are sensed may be compared with stored first data of footsteps/gait for respective persons. Matching both the facial structure and gait may confirm identity of the person.

A person's footsteps pattern/gait may vary depending on the person's mood, footwear, load, urgency, etc. The apparatus 11, 12 takes into account of such variation and produces an output responsive to the occasion (e.g. the footstep pattern may belong to a person A with variations possibly due to person A wearing snow boots—and the likelihood that the person would be wearing snow boots may be known based upon weather conditions that may be observed by the apparatus 10 or received via the internet, etc.). Many parameters may be combined to increase the accuracy of determining that there is a match. However, in cases of an iris or blood patterns therein that are prone to change constantly, the apparatus 11, 12 accounts for such changes in monitoring the parameters. Hence, if a detected iris (or the blood vessel patterns therein) is 100% identical to a stored iris of the user or of another usually authorized person, then it is likely that the data must have come from stored data and the apparatus 11, 12 would deem the detected iris parameter as a mismatch. In such case, it is likely that either the iris parameter was stolen or the apparatus 11, 12 is being hacked; the apparatus then would provide a notification output to that effect.

If there is a match, the method returns to step 152. If there is no match, the comparator 75 transmits the unmatched variable personal parameter(s) and comparison result(s) to the controller 72. At step 158, the controller 72 creates an output based on the comparison result(s) and/or other relevant data. The output may include a prediction of a possible occurrence of an undesirable event. As an example, a break-in may be detected (e.g., a broken window occurs) or predicted (e.g., an unrecognized person is detected approaching a window), as is described above, and based on inputs to the controller 72 the controller may determine which window is broken or is predicted to be broken. In another example, at step 158 the apparatus 10 may detect that a person at the facility 13 is having a heart attack based on parameters sensed by various sensors 14.

After step 158, the method proceeds to one or more of steps 160A, 160B, 160C, 160D (or similar steps). At step 160A the controller 72 alerts the user by transmitting the output to the user device 17, e.g., transmits an output to a user device 17 to inform the user of the occurrence of the undesirable event. At step 160B the controller 72 asks for a user instruction (e.g. whether to alert the call center 18 and/or authorities 19, whether to activate automatic equipment in the facility 13, whether to erase or to add a new set of Vpp information to the memory 74 to identify a new person who would be considered authorized to enter the facility, etc. At step 160C the controller 72 alerts the call center 18 and/or authorities 19, and at step 160D the controller activates automatic equipment in the facility. Step 160C may occur when the user is away on a vacation or the user may be unconscious due to injury, heart-attack, fire, etc. The activating of automation equipment may include, for example, closing a door, activating a sprinkler system, or some other automated equipment or apparatus in the facility 13.

After step 160A, the method follows to step 162 whereupon the controller 72 stores the output in the memory 74 and returns to step 152. After step 160B, the controller 72 reviews the user instruction(s) at steps 164A-C and performs an action pursuant to the user instruction. After step 160C, the method returns to step 152.

At step 164A, the controller 72 determines whether the user instruction is to erase or discard the unmatched variable personal parameters (Vpp). If the controller determines the instruction is to erase/discard, then the method proceeds to step 166 at which the controller 72 determines whether the unmatched variable personal parameters may be used to make a future prediction (e.g. the unmatched variable personal parameter(s) may exhibit parameters or patterns of persons planning a burglary and used to identify them at a later time). If the controller 72 determines that the unmatched variable personal parameter(s) may not be used to make a future prediction, then at step 168 the controller 72 erases the unmatched variable personal parameter(s) and returns to step 152. If the controller 72 determines that the unmatched variable personal parameter(s) may be used to make a future prediction, then at step 170 the controller 72 stores the unmatched variable personal parameter(s) in memory 74 or other storage (not shown) temporarily and with an indication that a person identified by such Vpp is not authorized to enter the facility or some other negative designation, e.g., the person is likely to commit a theft, burglary, etc. The method then returns to step 152.

At step 164B, the controller 72 determines whether the user instruction is to learn the unmatched variable personal parameter(s). If the answer is no, then the method proceeds to step 166 and follows the steps described above. If the answer is yes, the method proceeds to step 172 at which the controller 72 learns the unmatched variable personal parameter(s). Thereafter, at step 174 the controller 72 stores the unmatched variable personal parameter(s) in the memory 72 or other storage (not shown), and then the method returns to step 152.

At step 164C, the controller 72 determines whether the user instruction is to alert the call center 18 and/or authorities 19 or activate automation equipment in the facility 13.

If the answer is affirmative, at step 176 the controller 72 alerts the call center 18 and/or authorities 19 or can activate automatic equipment (not shown) in the facility 13, and then the method returns to step 152. If the answer is negative, the method returns to step 152.

There are additional possible scenarios such as activating automatic equipment in the facility 13. It is clear that not all the possible scenarios are described, even for this example. As the apparatuses 10 in the field communicate various scenarios to a corporate data base, for example, more scenarios can be addressed through this technology and distributed to apparatuses in the field. For example, if a seizure or fall occurs, the data for this can be transmitted to a central data base that can then learn to recognize seizures or falls and differentiate between them and a new improved algorithm from the learning process can then be downloaded to all the apparatuses in the field for improved recognition of a seizure or fall.

Figure 5:
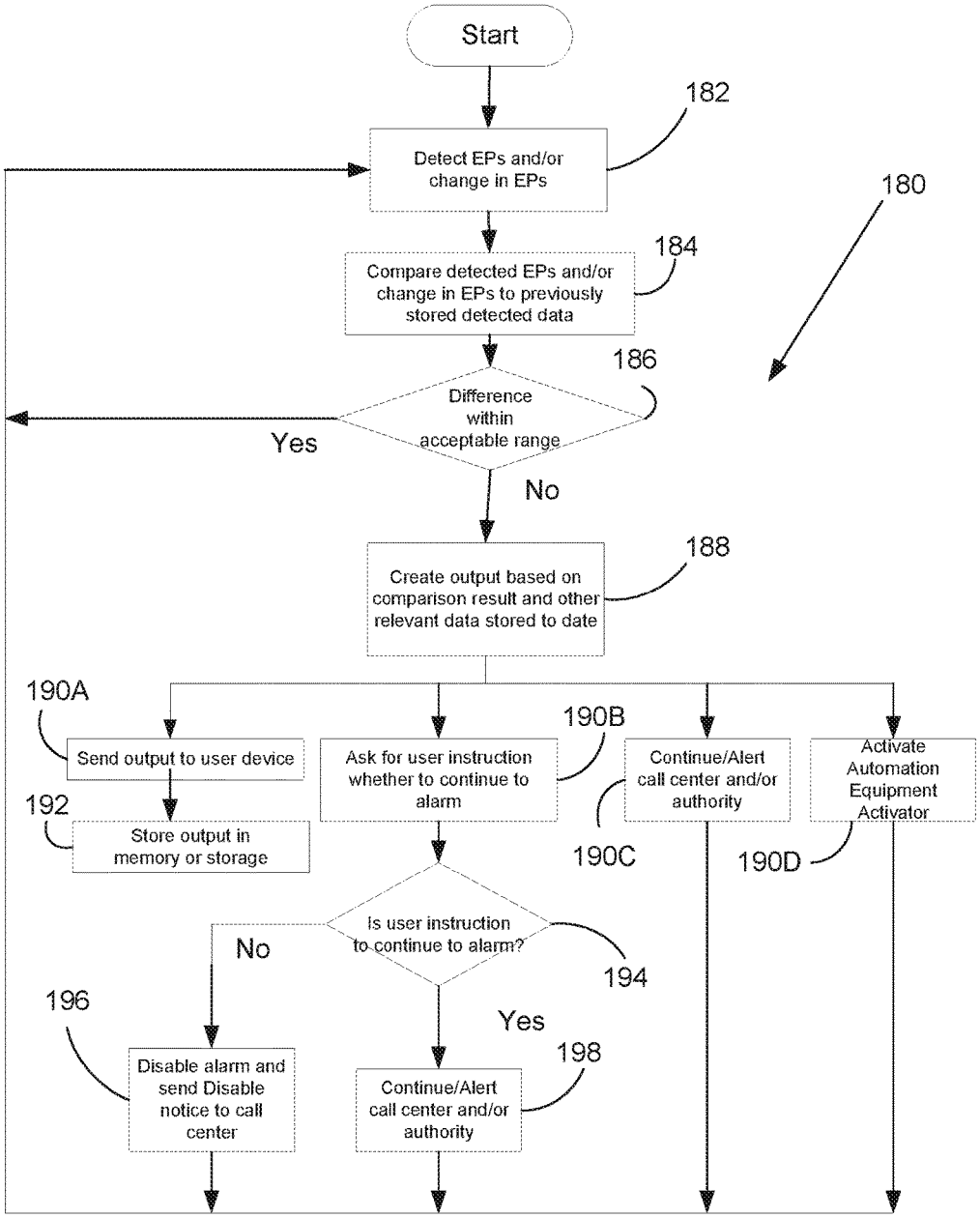
FIG. 5 is a flow chart illustrating an exemplary control method with respect to the detectors of the autonomous facility monitoring apparatus.

FIG. 5 is a flow chart illustrating an exemplary control method 180 with respect to the detectors 15 (FIG. 1) in accordance with the present disclosure. More particularly, the method 180 of FIG. 5 illustrates a control method for autonomous facility monitoring using the environmental parameters or change of the environmental parameters detected by the detectors. At step 182, at least one detector 132-146 detects real-time environmental parameters and/or change in the environmental parameters. The change may be detected by a detector or parameter values from a detector may be provided the controller 72 and stored in memory 74; and the controller may compute changes in the parameter. Alternatively, the comparator 74 may determine, e.g., compute/calculate, the change in parameter. At step 184, the comparator 74 compares the real-time environmental parameters or change thereof to the stored environmental parameters and/or to an acceptable range of the parameters (a second stored data).

At step 186 the controller 86 determines whether there is a difference between the incoming input from the detectors 132-146 and the second stored data. If the difference between the second incoming input and the second stored data does not constitute an undesirable event, the difference would be within the stored acceptable range of the pertinent environmental parameter(s), etc.), the method returns to step 182. If the difference constitutes an undesirable event or falls outside of the acceptable range, the method proceeds to step 188 at which the controller 72 sounds an alarm and creates an output based on the comparison result(s) and other relevant data (e.g. whether the change had previously occurred before and, if so, the action(s) taken by the user, etc. The output may include a prediction of an undesirable event such as water leak, injury, possible fire occurring or about to occur in the future and so forth.

After step 188, the controller 72 may perform one or more of steps 190A-D. At step 190A, the controller 72 sends the output to the user device 17 and then at step 192 the controller 86 stores the output in the memory 74 or a storage device/medium). At step 190B, the controller 72 asks for a user instruction whether to sound an alarm and at step 194 the controller 72 determines whether the user instruction is to continue to alarm. If it is determined that the instruction is not to continue the alarm, the method proceeds to step 196 at which the controller 72 disables the alarm and sends a disable notice to the call center 18, e.g., to cancel the alarm notification; and thereafter, the method returns to step 182. If the instruction at step 194 is to continue the alarm, the method proceeds to step 198 at which the controller 72 continues the alarm and alerts the call center 18 and/or relevant authorities 19 or activates automatic equipment in the facility (not shown), and then, the method returns to step 182. At step 190C, without asking for an instruction from the user, e.g., knowing the facility is unoccupied and that a potentially catastrophic event has been detected, e.g., a fire or gas leak, the controller 72 directly activates an alarm and alerts the call center 18 and/or relevant authorities 19 and/or activates automatic equipment in the facility, e.g., turning on a fire suppression sprinkler system or opening windows and activating a blower to evacuate the house of gas (not shown), and then, the method returns to step 182. The controller also may activate automatic equipment at step 190D, as was described above.

Figure 6:
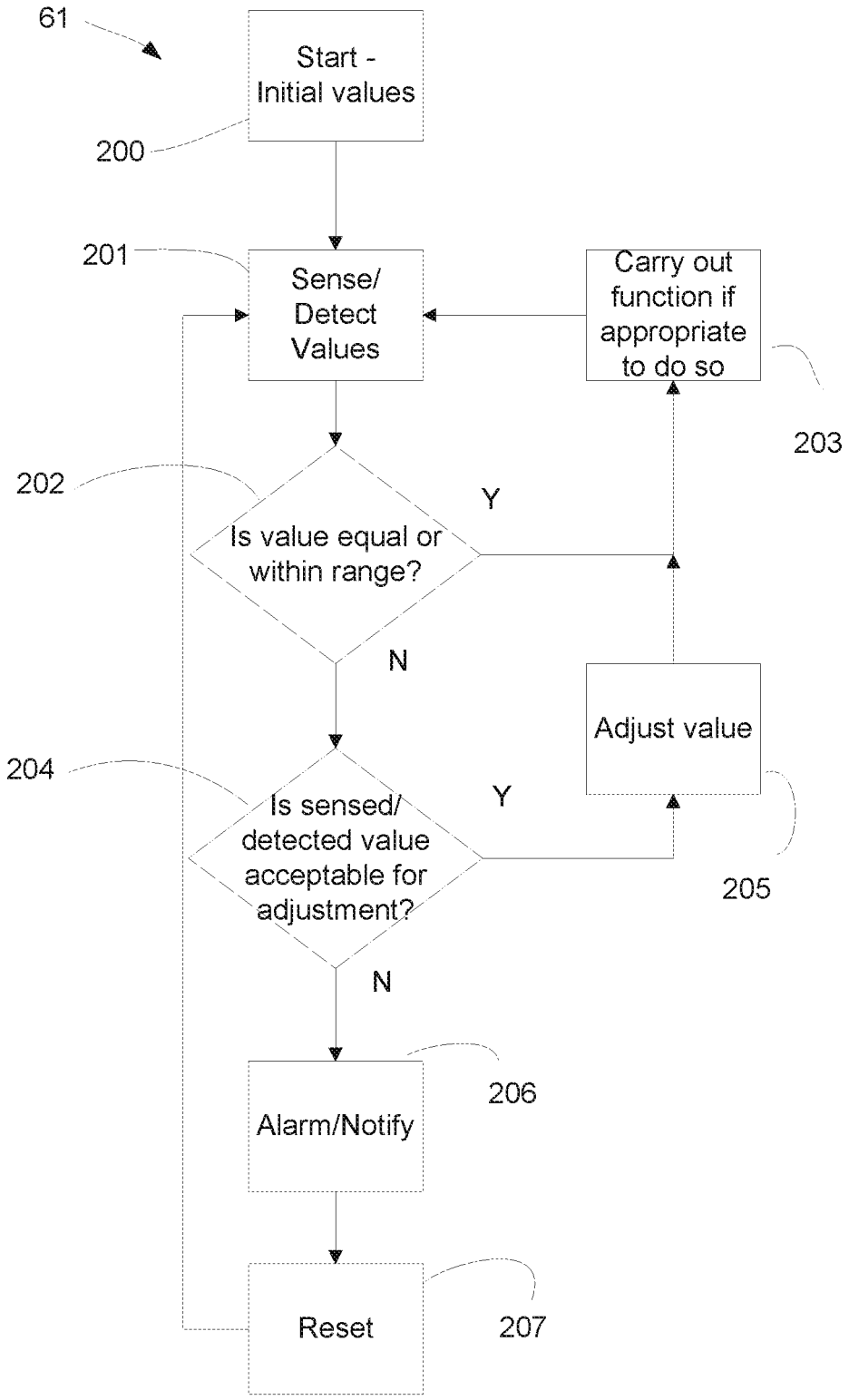
FIG. 6 is a flow chart illustrating an example of operation of the autonomous facility monitoring apparatus learning algorithm.

FIG. 6 is an exemplary flow chart representative of the learning algorithm 91 mentioned above illustrating exemplary steps that may be controlled and carried out by the controller 72 and other associated parts of the apparatus 10. At step 200 the apparatus 10 may be turned on—it starts. Initial values for various parameters that would be monitored by the sensors 14 and detectors 15 may be input by the user, by the manufacturer of the apparatus 10, or both. At step 201 the respective sensors 14 and detectors 15 carry out their respective functions. At step 202 an inquiry is made for a respective sensed or detected parameter to determine whether the value of the parameter is equal to that which had been stored in memory 74 (or stored elsewhere) or is within an acceptable range. If yes, then at step 203 an appropriate function may be carried out based on the parameter, e.g., continue with running air conditioning or heating in the facility, leaving on or off lighting, and so on. However, if at step 202 the inquiry is negative, i.e., the value is not equal to an expected value or within an expected range of values, then at step 204 another inquiry is made to determine whether the sensed or detected value of the parameter is acceptable for adjustment. For example, if the parameter were room temperature, which is expected to be at about seventy degrees, and the detected value is one degree above or below seventy degrees, such minimal difference may be acceptable to allow for changing the stored or reference value (also referred to above as first data), then at step 205 the stored value (first data value) is adjusted to the actually sensed or detected value or appropriate revised range. Then, the method flows to step 203. Thus, the apparatus 10 has learned to adjust itself to the new parameter conditions.

At step 204 if the sensed/detected value is not acceptable for adjustment, e.g., in the above example the detected room temperature is one hundred fifty degrees or more, then this may indicate an emergency situation, e.g., fire has broken out and caused room temperature to rise to the high level. In such case the method flows to step 206 causing an alarm to be sounded and/or notifications sent to the user, e.g., via a user device 17 if not at home, and sent to a call center and/or to an appropriate authority, e.g., fire department or police department. At step 207 the alarm/notification and other portions of the apparatus 10 may be reset, e.g., by the user checking to confirm that there is no emergency and resetting the apparatus 10 or an appropriate portion of the apparatus.

Figure 7:
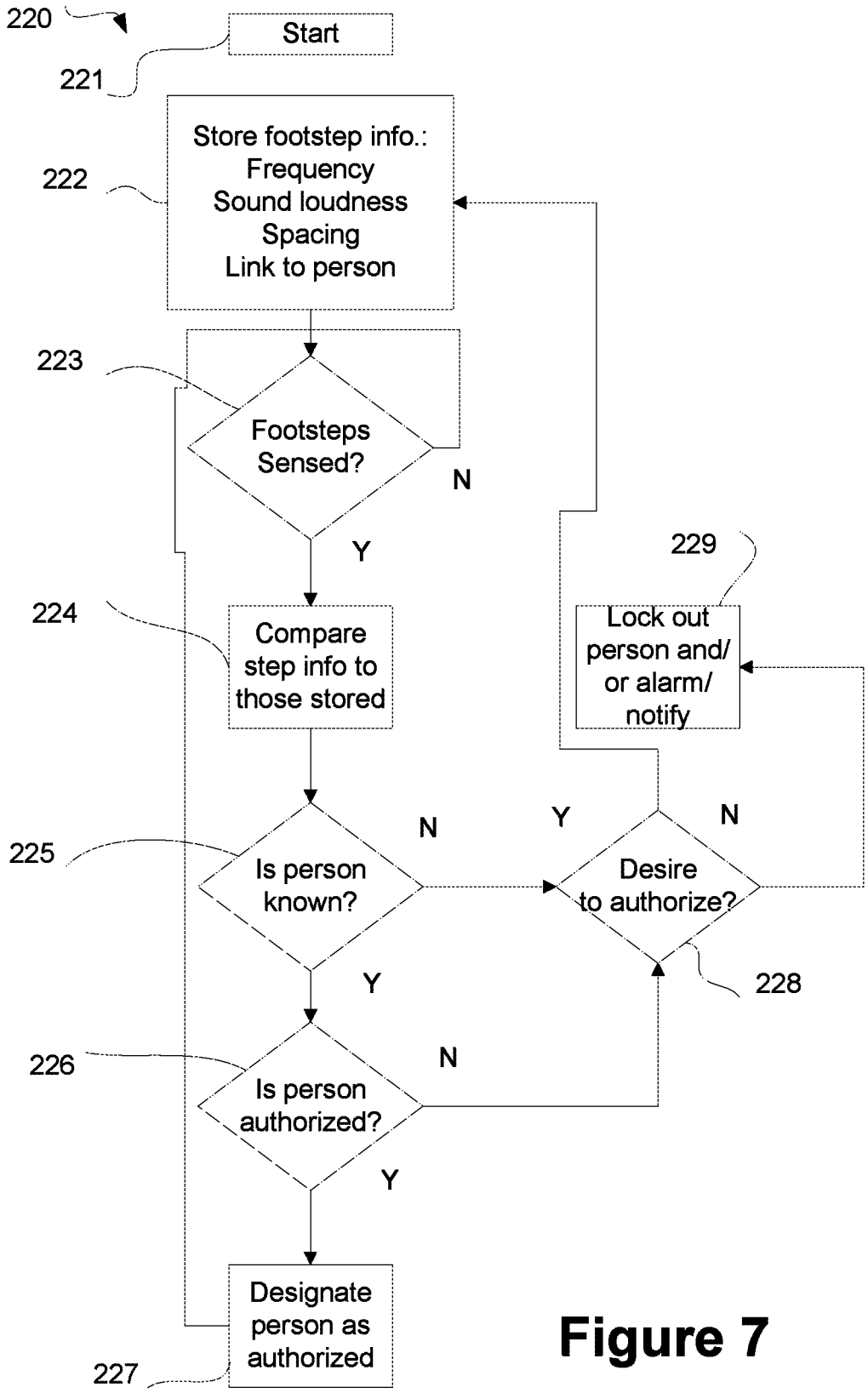
FIG. 7 is a flow chart illustrating an example of a footsteps detection method.

Turning to FIG. 7, a flow chart 220 representing a method for the apparatus 10 to sense a person in the facility based on footsteps, i.e., footsteps pattern or gait of the person. At step 221 the method starts. At step 222 information is stored in the apparatus 10, e.g., in the memory 74. The information may represent footstep frequency, loudness of the footsteps, the spacing of the footsteps, or some other characteristic of footsteps; and the information may be linked to a person, e.g., by name, number, and so on. Thus, a first person may have their footsteps/gait measured and stored. The frequency may represent typical speed of walking of the person; the loudness may represent the weight of the person; the spacing may represent the height of the person, e.g., longer or shorter leg length. The footsteps may be sensed based on a microphone receiving sound, based on a vibration sensor or seismometer type device, etc. the information may be provided via the controller 72 to the memory 74. The user may initially monitor their footsteps and then store that information/data linked with their name. Other acceptable persons may also have their footsteps pattern/gait stored with their name in the apparatus, e.g., spouse, children, friends, and so on—possibly even pets.

At step 223 an inquiry is made whether footsteps are sensed. If not, a loop is followed until footsteps are sensed. When footsteps are sensed at step 223, then at step 224 a comparison is made of the sensed footsteps relative to information that was stored previously. Based on the result of that comparison, then, at step 225 an inquiry is made as to whether the person belonging to the footsteps is known. If the person is known, then at step 226 an inquiry is made whether the person is authorized to enter or to be within the facility 13. If yes, then at step 227 the person is designated as authorized and no action to block the person from entering or being in the facility 13 is needed.

However, if at step 225 the person is not known, then at step 228 an inquiry is made whether the user desires to authorize that person. If yes, then the method flows to step 222 and the footstep patter of the person is stored in memory for future use when that person is detected, say entering the facility or walking in the facility in the future. However, if at step 228 the user of the apparatus 10 does not want to authorize the detected person, then the loop follows to step 229, whereupon the apparatus locks out the unauthorized person, sounds an alarm, notifies authorities, etc.

Briefly referring back to steps 225 and 226, although the person whose footsteps had been detected may be a known person determined at step 225—perhaps someone who was authorized to visit previously but no longer is authorized—then at step 226 the person is determined not to be authorized, and the method flows to step 228. At that point, if the user has again authorized the person, then such authorized designation is provided and the method flows to step 222 as described above. However, if at step 228 the user has not designated the person as authorized, then at step 229 the apparatus would lock out the person, e.g., locking the entrance door or not opening the door, and/or sounding an alarm and/or sending notification to appropriate authority, e.g., call center 18 or police 19.

An aspect of this disclosure relates to a monitoring apparatus, comprising, a detector configured to detect one or more environmental parameters associated with a facility, a sensor configured to sense one or more personal parameters associated with one or more respective persons within or in proximity of the facility, a memory configured to store detected environmental parameters and sensed personal parameters, a comparator configured to compare a current detected environmental parameter with a stored environmental parameter and/or a current personal parameter with a stored personal parameter, and an output configured to provide output indication of the result of comparison by the comparator.

In some embodiments, the detector is configured to detect at least one of temperature, carbon monoxide, fire, color, light, odor, voltage or electrical current as environmental parameter. In an embodiment the comparator comprises a controller cooperative with the comparator to integrate more than one detected environmental parameter to determine a negative environmental condition. In an embodiment the controller and comparator cooperate to integrate sensed voltage and/or electrical current with respect to temperature to determine whether a negative environmental condition exists to cause an output indicative of predicting a possible fire condition.

In an embodiment the controller and comparator are configured to integrate detected environmental parameters with sensed personal parameters to determine whether to cause an output indicative of a condition detrimental to a person, such as safety-critical alerts. In some embodiments, the parameters can be evaluated by an algorithm or analyzed and acted on by artificial intelligence such as machine learning. A machine learning model can be a supervised model trained prior to deployment or an unsupervised model. In an embodiment the sensor is configured to sense at least one of gait, weight, body temperature, breathing rate, breath odor (analysis of breath), heart rate, voice characteristic, or odor of a person. In an embodiment the memory is configured to store personal parameters representative of persons authorized to be at the facility, and the comparator is configured to compare a sensed personal parameter with a stored personal parameter for determining whether the sensed personal parameter is recognized as a person authorized to be at the facility.

An embodiment further comprises an input configured to designate sensed parameters as being associated with a person authorized to be at the facility. In an embodiment, in response to an input that a person is authorized, the parameters of such person are stored in memory as representative of a person authorized to be at the facility.

Another aspect relates to a monitor apparatus for a facility, comprising a sensor configured to sense vibration representing gait, a storage device configured to store data representing sensed gait of respective persons, a comparator configured to compare currently sensed gait data with stored gait data, and an output configured to provide an output indication of the result of comparison by the comparator representing whether the currently sensed gait is recognized. In an embodiment the sensor configured to sense noise or vibration comprises a seismic sensor.

Another aspect relates to a facility monitoring apparatus, comprising at least one sensor configured to continuously sense at least one variable personal parameter, at least one detector configured to continuously detect at least one environmental parameter, a storage medium configured to store sensed variable personal parameters and detected environmental parameters, a comparator configured to compare a currently sensed variable personal parameter and a currently detected environmental parameter, respectively, with respective stored variable personal parameters and respective stored environmental parameters, and an output configured to provide an indication representative of occurrence of a negative event based on result of a comparison by the comparator.

In an embodiment of the facility monitoring apparatus when the value of the sensed parameter and the value of the detected parameter do not correspond with respective range of values stored in the storage medium, a negative event is output to indicate presence of an intruder at the facility. In an embodiment the sensor is a seismic sensor. In an embodiment there are a plurality of seismic sensors, and wherein the comparator is configured to compare detected seismic data signals to provide output information indicative of location and/or direction of movement of an intruder at the facility. In an embodiment there are a plurality of seismic sensors, and wherein the comparator is configured to compare detected seismic data signals to provide output information indicative of location and/or direction of movement of a known person at the facility. In an embodiment the output is configured to provide an indication of a negative event that is at least one of intruder detection, fire detection, freeze detection or medical detection.

Another aspect relates to monitoring method, comprising detecting environmental and physical parameters of or in proximity to a facility, integrate data from the detecting to determine current status of the facility or proximity to the facility as represented by a plurality of the parameters, and determining based on the integrated data whether a negative event is occurring or is predicted to occur.

In an embodiment, integrating data from detecting comprises storing base value of one or more parameters that are detected, periodically storing respective detected values of parameters that are detected, comparing one or more of the respective stored base values with one or more periodically stored values of that parameter to determine trend of the respective detected value, and providing an output indicating a negative event or probability of a negative event occurring when the trend represents current occurrence of a negative event or likelihood of the occurrence of the negative event. An embodiment further comprises sensing one or more personal parameters associated with one or more persons, integrating data from the sensing to determine whether a person is recognized as a person authorized to be in or in proximity to the facility.

Another aspect relates to a method of personal monitoring, comprising sensing one or more personal parameters associated one or more persons, integrating data from the sensing to determine whether a person is recognized as a person authorized to be in or in proximity to the facility. An embodiment further comprises combining integrated data from plural detected environmental and physical parameters with integrated data from plural sensed personal parameters, comparing the result of said combining with prescribed values, and providing an output when the result of comparing is indicative of a negative event occurring or the probability that a negative event would occur within a prescribed time. In an embodiment the method is operative to run without having to be turned on or off as the facility respectively is exited or entered.

An embodiment further comprises upon sensing an unrecognized person is in the facility, providing opportunity to identify the unrecognized person as a designated person permitted to enter the facility, and selectively blocking access to one or more locations in the facility for such designated person. An embodiment further comprises providing an input indicating the designated person is a person fully authorized to enter the facility and permitting the designated authorized person access to all locations in the facility. In some embodiments, in addition to locations in the facility, the method can authorize, limit, and/or block access to electronic devices and information associated with the facility. In an embodiment, said sensing comprising sensing visual image of a person. An embodiment further comprises providing an alarm output in response to determining an intruder is in or is attempting to enter the facility. In an embodiment, in response to determining that a negative event is occurring or that a negative event is likely to occur within a prescribed amount of time, providing a notification output. In an embodiment said providing notification comprises at least one of sounding an alarm, transmitting an alarm via a communication system (text, email, phone), locking down the facility, locking out the facility, operating a fire suppression sprinkler, operating a water sprinkler, or turning off power to systems of the facility.

An embodiment further comprises automatically arming one or more security functions in response to recognizing that all persons have exited the facility. An embodiment further comprises automatically disarming specified functions in response to recognizing that a recognized authorized person has entered or is approaching the facility. In an embodiment at least some of said sensing is carried out without line of sight of a person whose personal parameters are sensed. An embodiment further comprises using the sensing to find the location of a person in the facility. An embodiment further comprises using such location information to direct private communications to the located person. In an embodiment using the sensing to find the location comprises obtaining information representing the person using at least one of visual recognition, voice recognition and sound level and direction characteristics, location of person's mobile phone or another personal Wi-Fi or cellular enabled device.

In an embodiment, triangulation can use the sensing from a plurality of sensors to find the location. In an embodiment a plurality of sensors are seismic sensors to indicate seismic information representing gait, location and direction of a person. An embodiment further comprises upon sensing presence of a person in a location in the facility, controlling one or more environmental parameters for that location. In an embodiment said controlling comprising controlling at least one of heat, light, sound system, television, radio, and access to electronic devices and information such as personal computers, mobile devices, cloud documents, and gaming devices. An embodiment further comprises based on at least one of sensed parameters or detected parameters, activating a panic signaling representing a danger situation. In an embodiment said sensing comprises sensing speech or sound and wherein said activating is based on a sensed sequence of speech or a sensed untoward event. An embodiment further comprises storing information representing personal parameters of at least one person.

An embodiment further comprises comparing personal parameters that are being sensed with personal parameters that are stored to determine the identity of one or more persons in the facility and directing communications that are intended for such respective identified one or more persons. In an embodiment said directing comprises directing personal communications for such identified person only to such identified person. An embodiment further comprises determining the location of an identified person in the facility and activating or deactivating apparatus of the facility based on such location. In an embodiment said activating or deactivating comprising at least one of turning on or off a light, turning on or off sound, turning on or off a television, and turning on or off access to information on an information system. In an embodiment said sensing comprises sensing personal health parameters of one or more persons, and indicating output representing the sensed personal health parameters for one or more respective persons in the facility.

In an embodiment sensing personal health parameters comprises sensing at least one of heart beat, breathing rate, odor, upright or prone position or speech characteristics. In some embodiments, sensing personal health parameters comprises sensing vibrations of the body after determining a fall has occurred and processing vibrations to determine activity such as a seizure. In an embodiment said indicating output comprises actuating an alarm in response to sensing that one or more persons is ill. An embodiment further comprises indicating the location in the facility of an ill person to facilitate rescue personnel locating the ill person in the facility. An embodiment further comprises storing personal health parameters with regard to respective persons who are authorized entry to the facility, and comparing current sensed personal health parameters of at least one person with stored personal health parameters of that person, and determining whether there is a difference between the values of the current sensed personal health parameters and the stored personal health parameters of the person as to indicate an ill condition of the person. In some embodiments, the ill condition can include changes to personal health parameters due to diabetes, pre-seizure activity, and the like.

An embodiment further comprises playing a game, and wherein the sensing comprises sensing changes in personal health parameters of a player while playing the game. An embodiment further comprises changing the level of difficulty of the game in response to the sensed personal health parameters. In an embodiment said changing comprising reducing the level of difficulty when heart rate or breathing rate of a player exceeds a predetermined level representative of excessive stress of the player. In an embodiment said changing comprising increasing the level of difficulty when the heart rate or breathing rate remains normal for the player for a predetermined time, thus being indicative of low challenge level for the player.

An embodiment further comprises using a camera to detect fire or smoke in the facility. An embodiment further comprises detecting brightness of at least part of an image as sensed by a camera as an indication of fire. An embodiment further comprises detecting darkness of at least part of an image sensed by a camera as an indication of smoke. An embodiment further comprises effecting an alarm signal in response to detecting fire or smoke. Another aspect relates to a method for detecting fire or smoke in a facility, comprising sensing an image in at least a part of the facility, and determining whether a portion of the sensed image is bright as a representation of existence of fire or of darkness as a representation of existence of smoke.

Another embodiment comprises effecting an alarm signal in response to detecting fire or smoke. In an embodiment said effecting an alarm signal comprising sounding an alarm in the facility and transmitting an alarm signal to local authority. An embodiment further comprises providing, in the alarm signal to local authority, instructions to rescue personnel indicating circumstance of an ill person and how to treat the person.

Another aspect relates to an autonomous facility monitoring apparatus comprising at least one sensor configured to detect at least one variable personal parameter or at least one change in the personal parameter and at least one detector configured to detect at least one environmental parameter or at least one change in the environmental parameter. The autonomous facility monitoring apparatus can include a comparator in electrical communication with the at least one sensor and the at least one detector and configured to compare a first incoming input from the at least one sensor with a first stored data representative of the at least one variable personal parameter or at least one change in the personal parameter for use in determining a matching relationship therebetween or to compare a second incoming input from the at least one detector with a second stored data representative of the at least one environmental parameter or at least one change in the environmental parameter or an acceptable range of the at least one environmental parameter or at least one change in the personal parameter.

In some embodiments, the autonomous facility monitoring apparatus can include a controller in electrical communication with the at least one sensor, the at least one detector and the comparator, wherein the controller is configured to receive a comparison result from the comparator, create an output having a prediction of a possible occurrence of an undesirable event based on the comparison result including at least one of unmatched variable personal parameter, detected environmental parameter or the change in the environmental parameter outside of the acceptable range, and at least one of transmit the output to a user device and store the output, ask for a user instruction, or send an alert with the output to a call center or relevant authority in electrical communication with the controller or activates equipment in the facility.

In an embodiment the autonomous facility monitoring apparatus is located indoor and/or outdoor, and is in electrical communication with the user device, the call center and the relevant authorities via a communication system. In an embodiment the outdoor autonomous facility monitoring system comprises a weather-proof case or cover. In an embodiment the communication system includes one or more of wireless, wired, Wi-Fi, Internet, Bluetooth™ or mobile communication connections. In an embodiment the at least one sensor includes two or more sensors acting in tandem or simultaneously to provide a higher probability of accurately recognizing one or more of the variable personal parameter or at least one change in the personal parameter, environmental parameter or the change in the environmental parameter.

In an embodiment the at least one sensor detects the variable personal parameter or at least one change in the personal parameter without having to visually recognize the variable personal parameter. In an embodiment the at least one sensor detects at least one change in the personal parameter through an obstruction. In an embodiment the at least one sensor comprises a sensor which maps a part or whole of a facility for use in detecting a change in the facility, and mapped data is used to compare the first stored data for an improved detection in conjunction with a sensor capable of visual detection or other sensor to increase a probability of an accurate recognition by the apparatus. Multiple detectors and available information are used to increase the probability of an accurate detection.

In an embodiment the at least one sensor comprises a laser which maps a part or whole of a facility for use in detecting a change in the facility, and mapped data is used to compare the first stored data for an improved detection in conjunction with a sensor capable of visual detection to increase a probability of an accurate recognition by the apparatus. In an embodiment the sensor capable of visual detection includes at least one camera. In an embodiment the at least one camera includes an infrared and/or thermal camera.

An embodiment further comprises a user device including one or more of a PC, a digital television, a mobile phone, a vehicle navigation device, a tablet, a watch, glasses or a PAD. In an embodiment the controller is further configured to perform one or more steps in accordance with a machine learning algorithm at least partly stored in a non-transitory memory, wherein the controller transfers information including a new parameter or pattern learned by the machine learning algorithm and a user history to a remote operation center in electrical communication with the apparatus for an analysis of the information and an improvement of the machine learning algorithm. In some embodiments, the remote operations center can include one or more remote devices (e.g., a cloud server). In some embodiments, the improvement can be automatically downloaded to the apparatus. In some embodiments, the apparatus can include a controller configured perform one or more steps to update a machine learning model based on a new parameter or pattern learned by a machine learning algorithm and a user history.

An aspect of this disclosure relates to a method for autonomously monitoring a facility comprising continuously detecting at least one variable personal parameter or at least one change in personal parameter, at least one environmental parameter, or at least one change in the environmental parameter and comparing the detected variable personal parameter or at least one change in the personal parameter to a first stored data representative of at least one variable personal parameters or change in personal parameters, and comparing detected environmental parameter or change in the environmental parameter to a second stored data representative of at least one environmental parameter or an acceptable range of the change in the environmental parameter. In some embodiments, the method of autonomous facility monitoring can include creating an output representative of predicting an undesirable event based on a comparison result including one or more of unmatched variable personal parameter or the change in the personal parameter, detected environmental parameter or the change in the environmental parameter outside of the acceptable range, and at least one of transmitting the output to a user device and storing the output, asking for a user instruction, or sending an alert with the output to a call center or relevant authority or activating automatic equipment in the facility.

In an embodiment the method further comprising: transferring information including a new parameter, pattern or alteration learned by a machine learning algorithm, or a user instruction history, to a remote operation center for an analysis of the information and an improvement of the machine learning algorithm; and receiving the analysis and the improvement automatically from the remote operation center. In an embodiment the detecting and/or the comparing comprises using at least one of a PC, a digital television, a mobile phone, a vehicle navigation device, a tablet, a watch, glasses or a PAD.

Although the invention has been shown and described with respect to a certain embodiment or embodiments, it will be evident that alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A facility monitoring apparatus, comprising:

a detector in the facility configured to detect one or more environmental parameters associated with the facility;

a sensor positioned in the facility configured to sense one or more personal parameters associated with one or more respective persons within or in proximity of the facility without requiring visual line of sight of a person whose personal parameters are to be sensed, wherein the one or more personal parameters are attributes unique to each of the one or more respective persons, and wherein the facility monitoring apparatus operates autonomously relative to the one or more respective persons;

a memory configured to store the detected environmental parameters and the sensed personal parameters corresponding to one or more respective persons authorized to be at the facility;

a comparator configured to compare at least one of a current detected environmental parameter with a stored environmental parameter, and to compare at least one of a current detected personal parameter with a stored personal parameter for determining whether a sensed personal parameter is recognized as a person authorized to be at the facility; and an output configured to provide output indication of a result of comparison by the comparator.

2. The apparatus of claim 1, wherein the detector is configured to detect at least one of temperature, carbon monoxide, fire, color, light, odor, voltage and electrical current as the one or more environmental parameters.

3. The apparatus of claim 1, wherein the sensor is configured to sense at least one of gait, weight, body temperature, breathing rate, breath odor (analysis of breath), heart rate, voice characteristic, and odor of a person as the one or more personal parameters.

4. The apparatus of claim 1, further comprising an input configured to designate sensed parameters as being of the one or more persons authorized to be at the facility.

5. The apparatus of claim 4, wherein in response to the input, the parameters of such person are stored in memory as representative of the one or more persons authorized to be at the facility.

6. A facility monitoring apparatus, comprising:

a detector in the facility configured to detect one or more environmental parameters associated with the facility;

a sensor positioned in the facility configured to sense one or more personal parameters associated with one or more respective persons within or in proximity of the facility;

a memory configured to store the detected environmental parameters and the sensed personal parameters corresponding to one or more respective persons authorized to be at the facility;

a comparator configured to compare at least one of a current detected environmental parameter with a stored environmental parameter and a current detected personal parameter with a stored personal parameter; and an output configured to provide output indication of a result of comparison by the comparator, wherein the output is further configured to output a negative output indication when the stored personal parameter and the detected personal parameter do not correspond with a respective range of values stored in the memory, and wherein the negative output indication causes the monitoring apparatus to restrict access to at least one of a location in the facility, an information system, and electronic data.

7. The apparatus of claim 1, wherein the sensor is a seismic sensor.

8. The apparatus of claim 1, further comprising a plurality of seismic sensors configured to output one or more seismic data signals, and wherein the comparator is configured to compare the one or more seismic data signals to provide a position and a direction to the output.

9. A method comprising:

detecting data corresponding to environmental parameters and physical parameters associated with a facility;

sensing, by a sensor positioned in the facility, one or more personal parameters associated with one or more respective persons within or in proximity of the facility without requiring visual line of sight of a person whose personal parameters are to be sensed, wherein the one or more personal parameters are attributes unique to each of the one or more respective persons, and wherein the facility monitoring apparatus operates autonomously relative to the one or more respective persons;

integrating the data to determine a current status of the facility as represented by a plurality of the parameters; and determining, based on the integrated data, whether a negative event is occurring.

10. The method of claim 9, further comprising integrating data from the sensing to determine whether a person is recognized as a person authorized to be in or in proximity to the facility.

11. The method of claim 9, wherein said sensing comprises sensing at least one or more of odor, gait, voice print, image, breathing pattern, and gas exchange of a person.

12. The method of claim 9, wherein said providing an output indicating the negative event comprises at least one of sounding an alarm, transmitting an alarm via a communication system (text, email, phone), locking down the facility, locking out the facility, operating a fire suppression sprinkler, operating a water sprinkler, and turning off power to systems of the facility.

13. The method of claim 9, further comprising using the sensing to find the location of a person in the facility.

14. A method comprising:

detecting data corresponding to environmental parameters and physical parameters associated with a facility;

sensing, by a sensor positioned in the facility, one or more personal parameters associated with one or more persons; and integrating the data to determine a current status of the facility as represented by a plurality of the parameters; and determining, based on the integrated data, whether a negative event is occurring, wherein integrating the data comprises:

storing a base value of one or more environmental parameters and physical parameters that are detected;

thereafter, executing an algorithm to:

detect the data corresponding to the one or more environmental parameters and physical parameters;

determine a trend of the respective detected data associated with the base value of the detected data;

determining the trend corresponds to a current occurrence of the negative event; and providing an output indicating the negative event.

15. A method comprising:

detecting data corresponding to environmental parameters and physical parameters associated with a facility;

sensing, by a sensor positioned in the facility, one or more personal parameters associated with one or more persons;

integrating the data to determine a current status of the facility as represented by a plurality of the parameters; and determining, based on the integrated data, whether a negative event is occurring, the method further comprising:

sensing an unrecognized personal parameter; and selectively blocking access to at least one or more of locations in the facility, information systems, and electronic data in response to the unrecognized personal parameter.

16. The method of claim 15, further comprising providing an access prompt associated with the unrecognized personal parameter.

17. A method comprising:

detecting data corresponding to environmental parameters and physical parameters associated with a facility;

sensing, by a sensor positioned in the facility, one or more personal parameters associated with one or more persons;

integrating the data to determine a current status of the facility as represented by a plurality of the parameters; and determining, based on the integrated data, whether a negative event is occurring, the method further comprising:

recognizing, using the one or more personal parameters, that all persons have exited the facility; and thereafter, arming one or more security functions.

* * * * *